United States Patent [19]

Yokoi et al.

[11] Patent Number: 4,995,745

[45] **Date of Patent: * Feb. 26, 1991**

[54] PRINTER WITH MULTI-FUNCTION PAPER FEEDING MECHANISM

[75] Inventors: Takeshi Yokoi, Kagamigahara; Shigeo Nakamura; Hiroshi Yamanaka, both of Nagoya, all of Japan

[73] Assignee: Brother Kogyo Kabushiki Kaisha, Japan

[ * ] Notice: The portion of the term of this patent subsequent to Feb. 6, 2007 has been disclaimed.

[21] Appl. No.: 386,692

[22] Filed: Jul. 31, 1989

Related U.S. Application Data

[63] Continuation of Ser. No. 87,827, Aug. 21, 1987, Pat. No. 4,898,488.

[30] Foreign Application Priority Data

| | | | |
|---|---|---|---|
| Aug. 22, 1986 | [JP] | Japan | 61-197916 |
| Mar. 28, 1987 | [JP] | Japan | 62-74980 |
| Apr. 7, 1987 | [JP] | Japan | 62-86125 |

[51] Int. Cl.[5] ..... B41J 11/50

[52] U.S. Cl. ..... 400/605; 400/616.2; 400/618; 400/625; 400/642; 226/143; 226/196

[58] Field of Search ..... 400/605, 616, 613, 646, 400/647, 647.1, 624, 625, 616.1, 616.2, 613.1, 613.2, 633, 633.1, 607, 607.2, 607.3, 608.2, 608.3, 608.4; 226/196, 199, 143; 271/9

[56] References Cited

U.S. PATENT DOCUMENTS

| | | | |
|---|---|---|---|
| 4,204,668 | 5/1980 | Yanagawa | 271/9 |
| 4,204,685 | 5/1980 | Yanagawa . | |
| 4,234,261 | 11/1980 | Hendrischk et al. | 400/616.2 |
| 4,360,279 | 11/1982 | Sugiura | 400/618 |
| 4,565,462 | 1/1986 | Yamamoto et al. | 400/625 |
| 4,569,610 | 2/1986 | Drejza et al. | 400/599 |
| 4,572,418 | 2/1986 | Hirat | 400/608.2 |
| 4,606,663 | 8/1986 | Christoph et al. | 400/605 |
| 4,619,197 | 10/1986 | Pailler | 400/605 |
| 4,635,916 | 1/1987 | Medngnee et al. | 226/199 |
| 4,652,161 | 3/1987 | Crean et al. | 400/625 |
| 4,664,545 | 5/1987 | Hanyu et al. | 400/616.2 |
| 4,671,686 | 6/1987 | Howes et al. | 400/605 |
| 4,742,287 | 5/1988 | Yokoi et al. | 400/605 |
| 4,743,131 | 5/1988 | Atwell | 400/613.2 |
| 4,747,717 | 5/1988 | Andersson | 400/616.2 |
| 4,789,258 | 12/1988 | Gomoll et al. | 400/605 |
| 4,898,488 | 2/1990 | Yokoi et al. | 400/642 |

FOREIGN PATENT DOCUMENTS

| | | | |
|---|---|---|---|
| 3509938 | 9/1985 | Fed. Rep. of Germany | 400/605 |
| 51177 | 3/1983 | Japan | 400/605 |
| 59-229371 | 12/1984 | Japan . | |
| 56577 | 4/1985 | Japan | 400/605 |
| 56578 | 4/1985 | Japan | 400/605 |
| 61-90544 | 6/1986 | Japan . | |
| 61-130447 | 8/1986 | Japan . | |
| 61-175065 | 8/1986 | Japan . | |
| 61-181745 | 11/1986 | Japan . | |
| 626832 | 12/1981 | Switzerland . | |
| 1600828 | 10/1981 | United Kingdom . | |

OTHER PUBLICATIONS

IBM Technical Disclosure Bulletin, vol. 28, No. 4, Sep., 1985, "Paper Path Switching Mechanism for Automatic Sheet Feeder in a Printer".

*Primary Examiner*—Eugene H. Eickholt
*Attorney, Agent, or Firm*—Oliff & Berridge

[57] ABSTRACT

A printer includes improved paper feeding mechanism. A manual paper guide plate below an automatic paper feeding device can guide a thick piece of paper into a printing position on the platen without bending it hard around the platen. A pin tractor below the manual paper guide plate can feed a continuous web substantially straight into the printing position. A print head below the platen prints out on the lower surface of printing paper, whereby the printed individual cut sheets of paper being piled up one after another with the printed surface facing downward in a proper page order. A paper tray for holding the printed paper can alternatively change its position to reverse the discharge direction of the printed continuous web. The printed and reversed paper can be stacked on the upper surface of the manual paper guide plate.

22 Claims, 20 Drawing Sheets

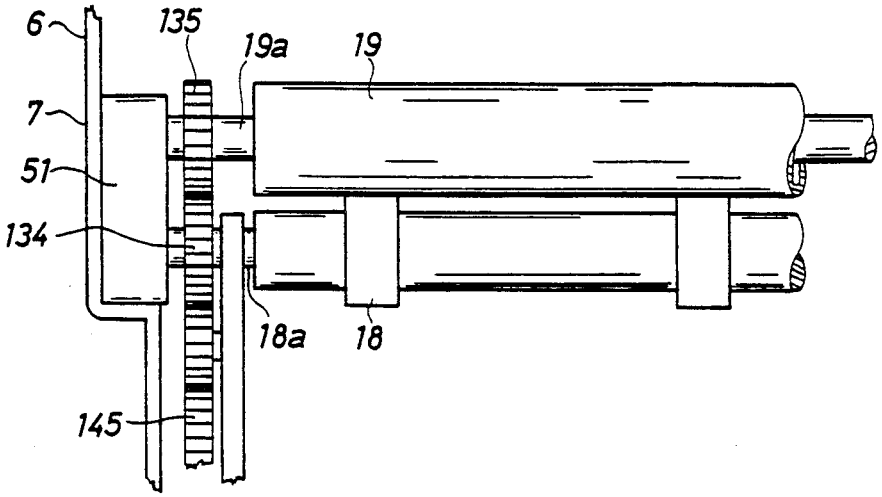
FIG. 5
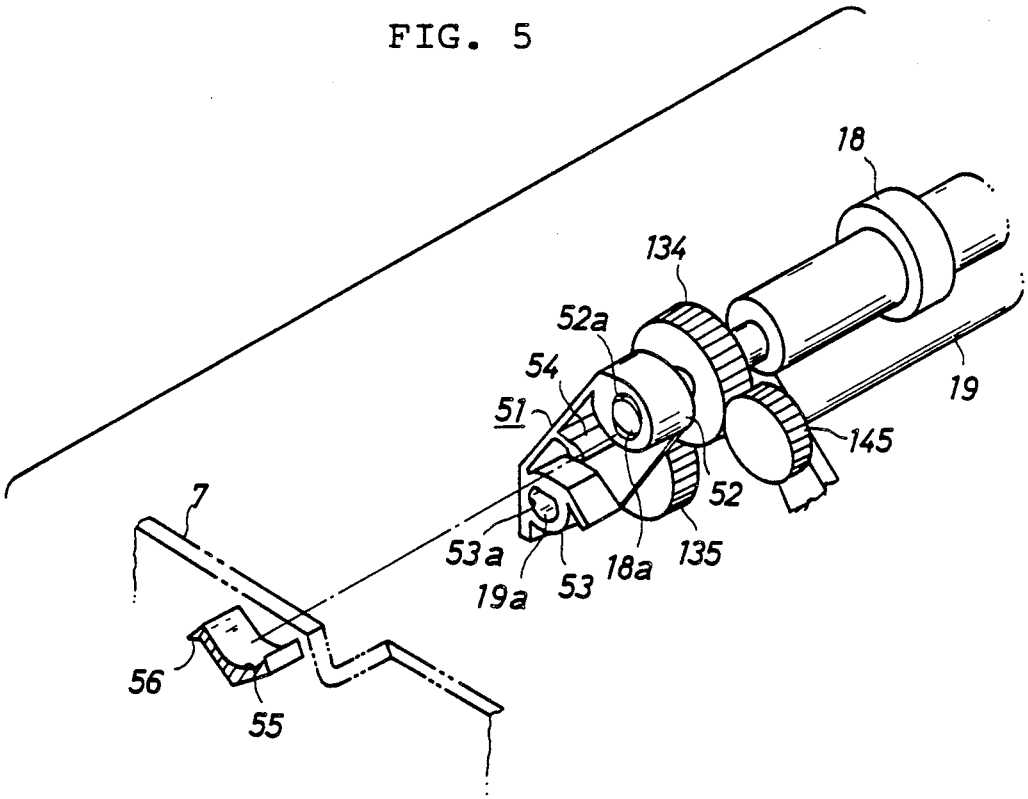

PRINTER WITH MULTI-FUNCTION PAPER FEEDING MECHANISM

This application is a continuation of application Ser. No. 07/087,827 filed Aug. 21, 1987, now U.S. Pat. No. 4,898,488.

BACKGROUND OF THE INVENTION

The present invention relates generally to a printer with a paper feeding mechanism and more particularly to a printer with a print head and a paper guide path.

The prior art printer of this kind is provided with a semi-circular paper guide path extending around the circumference of the cylindrical platen from the rear of the platen to the printing position on the front surface of the platen. A paper feeding device is located behind the platen so as to feed sheets of paper one after another automatically into the paper guide path, and an insert slit is formed between the paper feeding device and the platen so that a piece of paper is manually inserted from the insert slit. A paper tray is disposed near the paper discharging portion so as to receive the individual cut printed sheets one after another. Furthermore, a pin tractor unit is located below the paper feeding device so that a continuous web with pin feed holes on both outer edges thereof is guided into the paper guide path from the rear of a paper path which extends from the paper feeding device to the paper guide path. Moreover, a print head of the prior art printer is disposed sideward in front of the platen so as to print out on the upper surface of the printing paper which is advanced around the platen's circumference.

When a sheet of paper is inserted by hand from the insert slit of the prior printer described above, the printing paper is necessarily bent with a small radius around approximately two thirds or three quarters of the platen's circumference. Particularly, rather thick paper like a postcard is bent so hard that it is difficult to handle after being printed. In order to solve this problem, it may be possible to enlarge the platen's diameter or to shorten the range of the platen's circumference where a printing paper is rotated. However, in this case, the insert slit must be positioned apart from the platen rearward, and accordingly the paper feeding device near the insert slit must be also moved rearward, resulting in another problem, namely, enlargement of the whole printer unit.

On the other hand, when a continuous web is fed along the platen of the prior art printer, it is inserted into the paper guide path from the rear of the paper path, extending from the paper feeding device, to the paper guide path. As a result, the front edge of the sheet advances across the paper path and sometimes hits the platen's circumference, resulting in paper clogging. In order to solve this problem, the printer has to be equipped with a special device, such as the invention of U.S. patent application No. 799,753 made by the same inventor as this present application and filed on Nov. 19, 1985 which was abandoned in favor of continuation application Ser. No. 122,524, which was allowed on May 9, 1988 (U.S. Patent No. unknown).

Another problem occurs with regards to page order of the individual cut type printed sheets. To elaborate, since the printed sheets with their upper surfaces printed by the print head are discharged and piled up one after another on the paper tray in the rear of the platen, the operator has to rearrange all the pages backward after printing is completed.

Still another problem occurs as concerning a method for discharging the continuous web. On condition that the continuous web is discharged to be piled up in the same direction as the individual cut form sheets are, it requires a space large enough for stacking the printed paper of both types. Some improvement has been made so as to solve this disadvantage in such a manner that the discharge direction of the continuous web is reversed at the outlet so as to discharge the paper to pass over the printer and to fold it under the paper which is already folded in order to be fed into the printer. However, there exist still another problems in spite of the improvement, that is: since the prior art printer is not equipped with a special paper guide at the outlet in order to discharge the printed continuous web smoothly, the web may get loose at the outlet, which interrupts the smooth paper discharge; and furthermore, since the printing paper which will be printed and the printing paper which has been already printed are piled on the same table as the printer, it is difficult for the operator to handle those different kinds of paper.

SUMMARY OF THE INVENTION

It is accordingly an object of the present invention to provide a printer with a paper feeding device which can feed a thick piece of paper without bending it hard along the platen.

It is a further object to provide a printer which can optionally feed a continuous web smoothly without causing paper clogging.

It is a further object to provide a printer which can discharge individual cut sheets printed on the lower surface thereof one after another and pile them up in the proper page order.

It is a further object to provide a printer with a reverse guide plate disposed at a paper discharge portion so as to selectively reverse the discharge direction of the continuous web.

It is a further object to provide a printer with a paper stacker tray which can be alternatively used as a paper discharge guide so as to reverse the discharge direction of the continuous web.

It is a further object to provide a printer with a paper guide plate which can be alternatively used as a paper stacker where the printed continuous web is stacked, and which includes a hook for preventing the stacked web from proceeding toward the printing position.

BRIEF DESCRIPTION OF THE DRAWINGS

The invention will now be described with reference to the accompanying drawings. A first embodiment of the invention will be illustrated according to FIGS. 1 through 17 in which:

FIG. 4 is a partial plan view illustrating the support construction of the feeding roller for discharging paper;

FIG. 5 is a partially cutaway perspective view illustrating the above construction;

Figure 18:
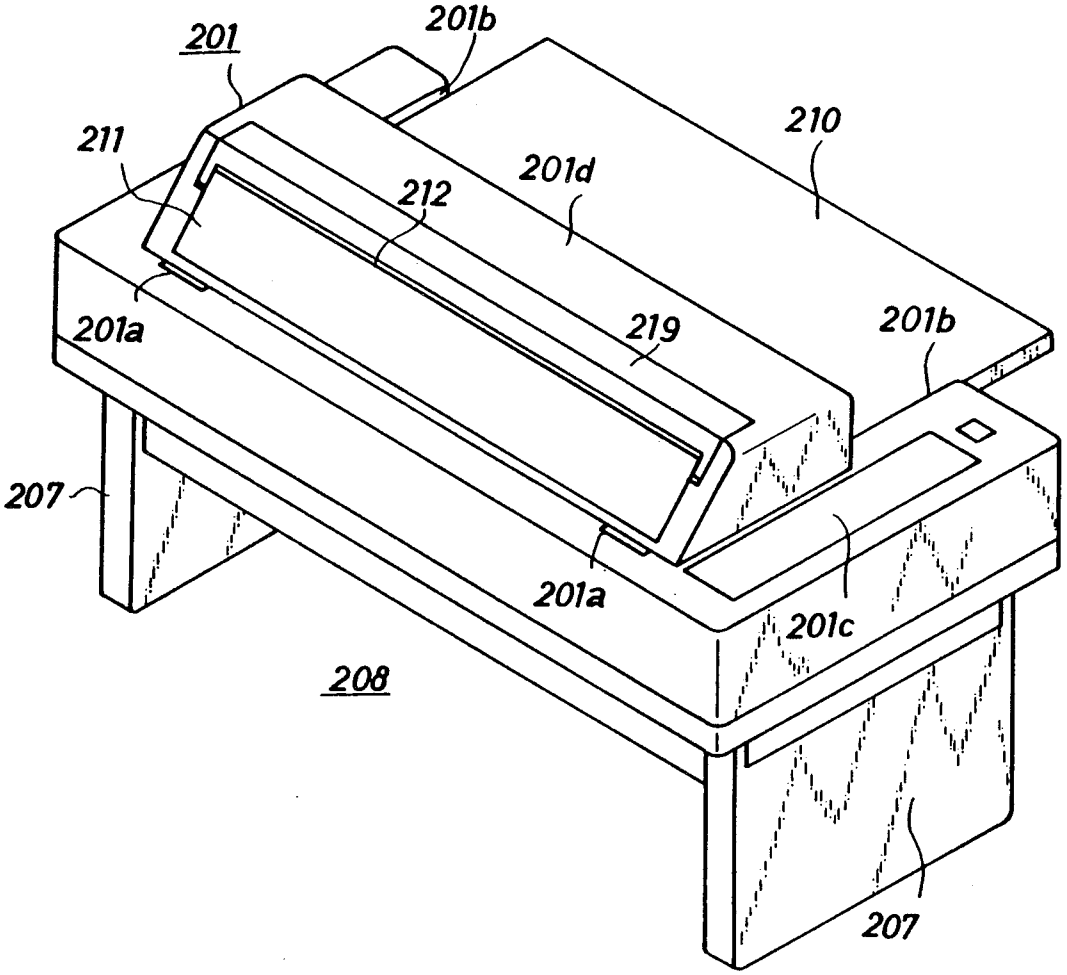
Figure 19:
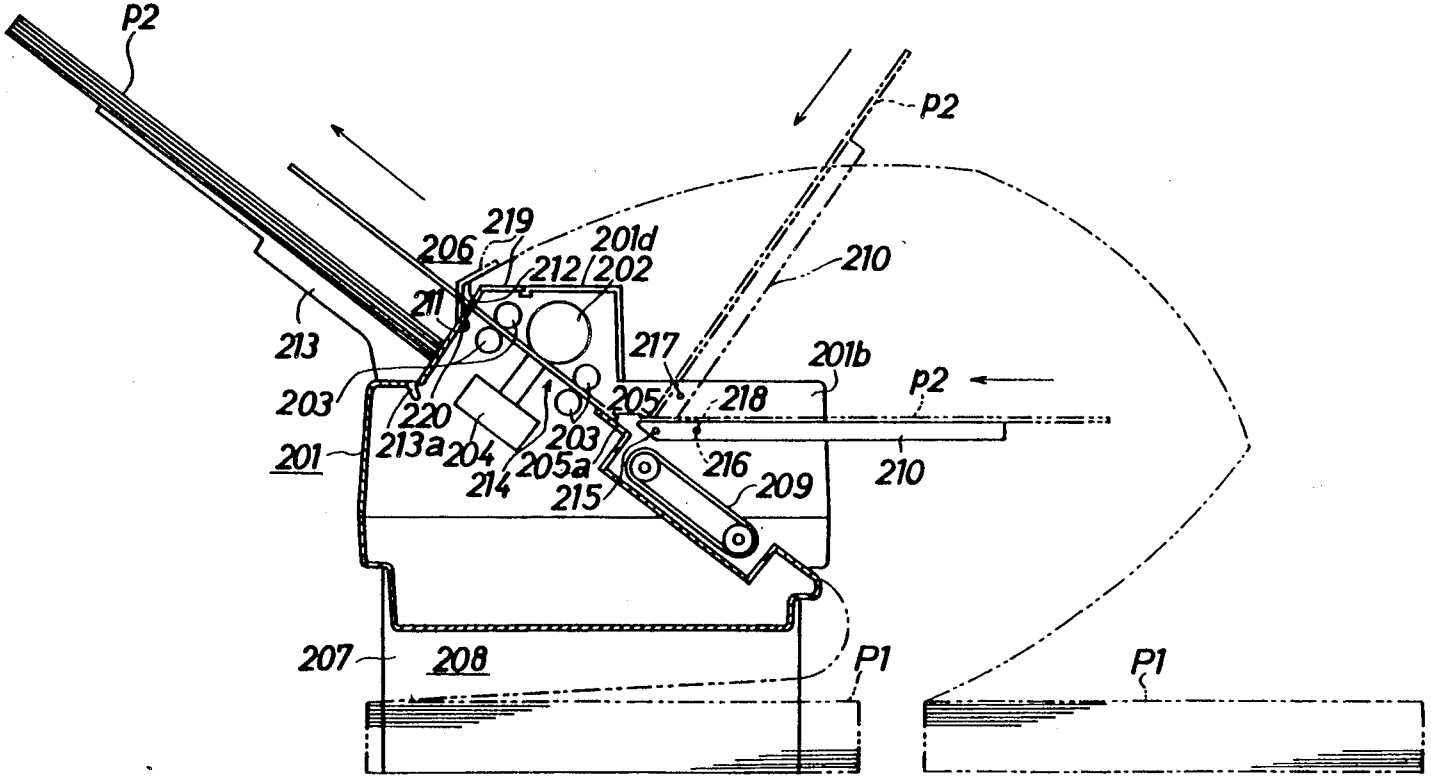
Figure 20:
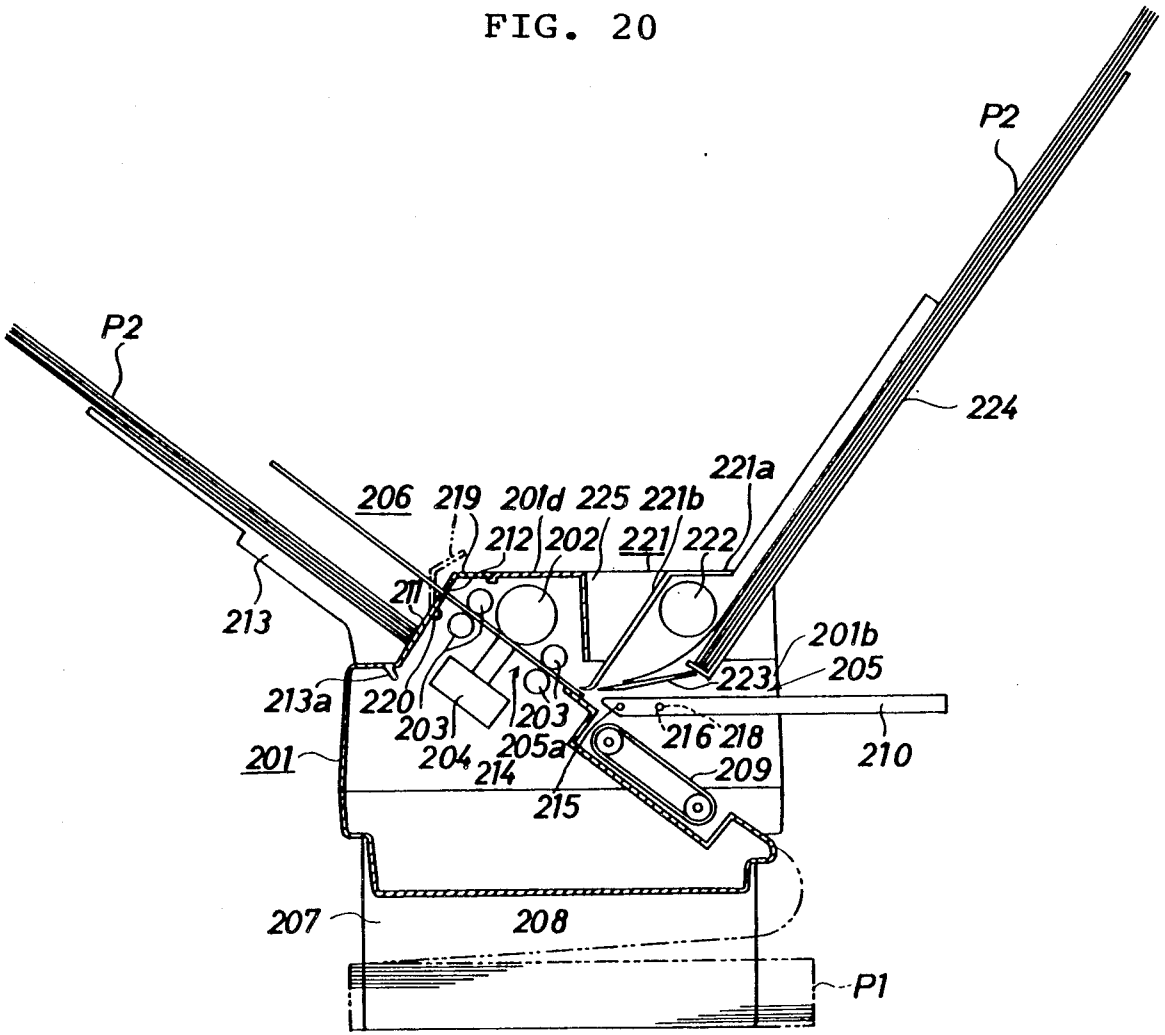
Figure 21:
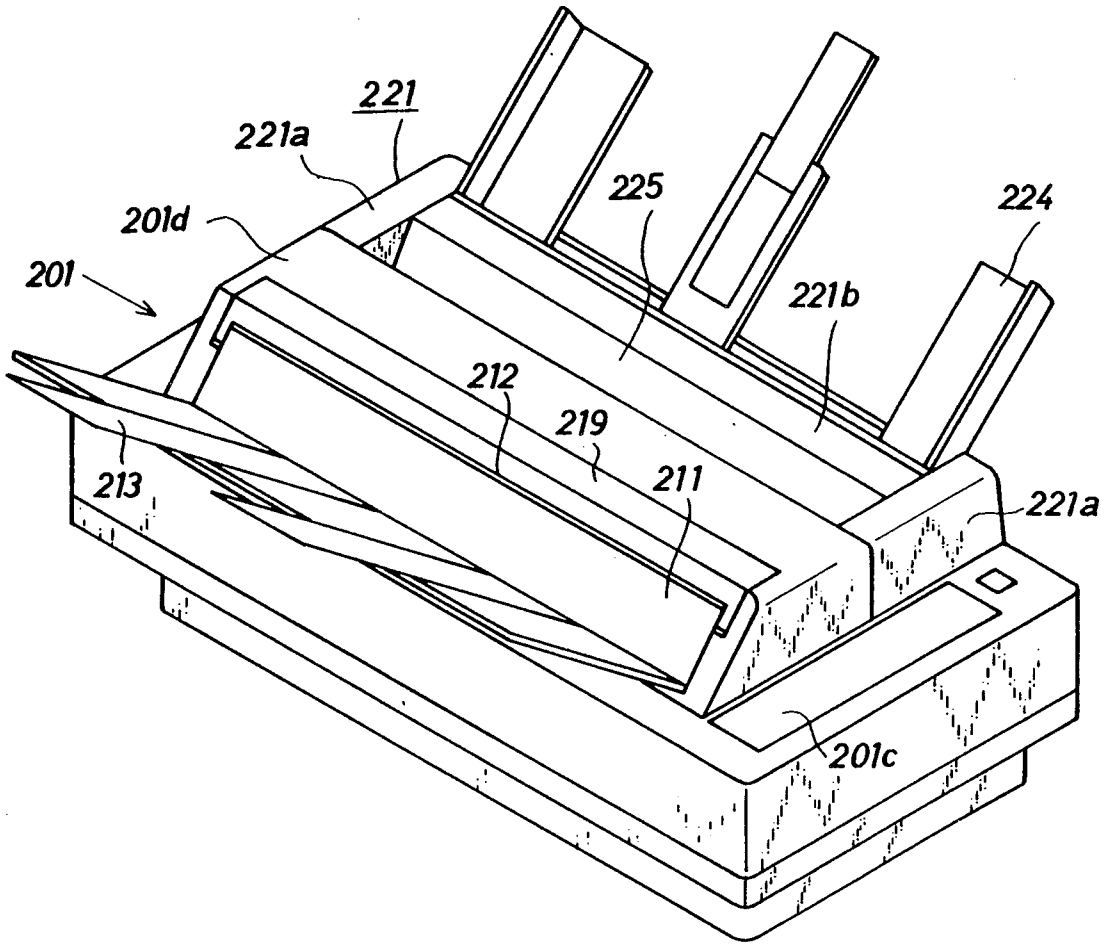

A second embodiment of the present invention will be described according to FIGS. 18 through 21 in which:

FIG. 18 is a perspective illustration of the printer in the second embodiment;

FIG. 19 is a longitudinal section of the printer;

FIG. 20 is a longitudinal section of the printer installed with an automatic paper feeding device; and FIG. 21 is a perspective illustration of the printer installed with the automatic paper feeding device.

Figure 22:
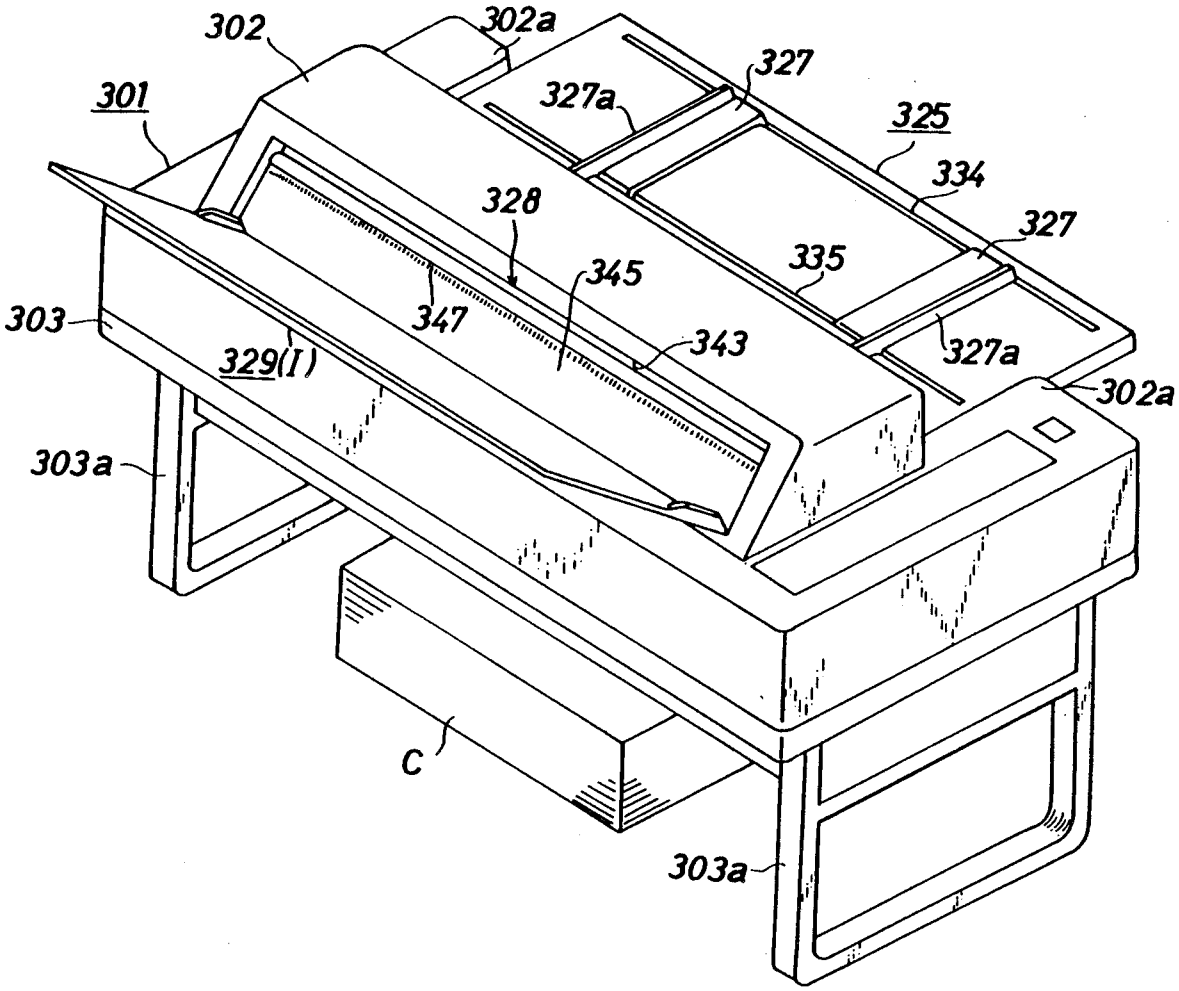
Figure 23:
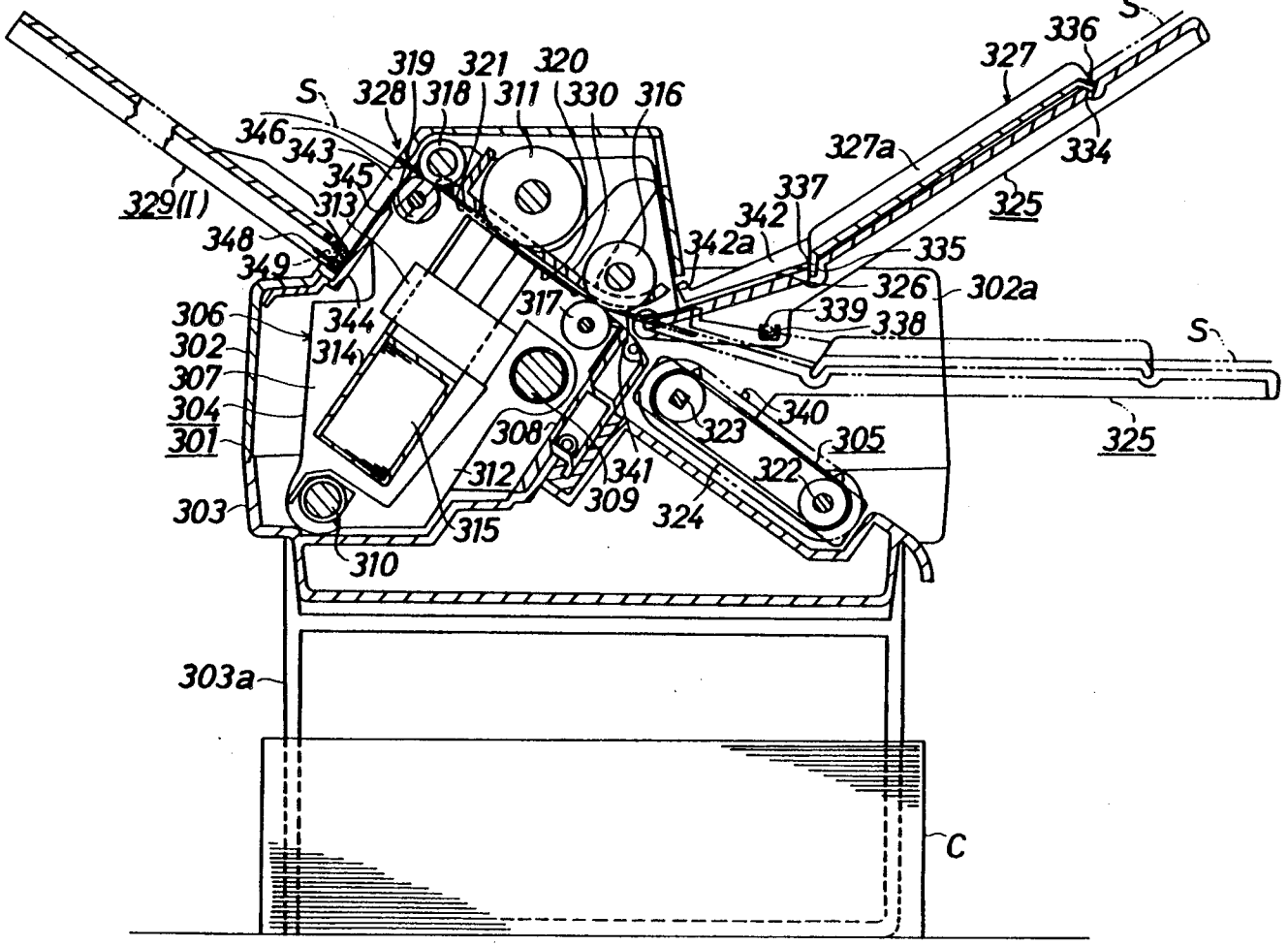
Figure 24:
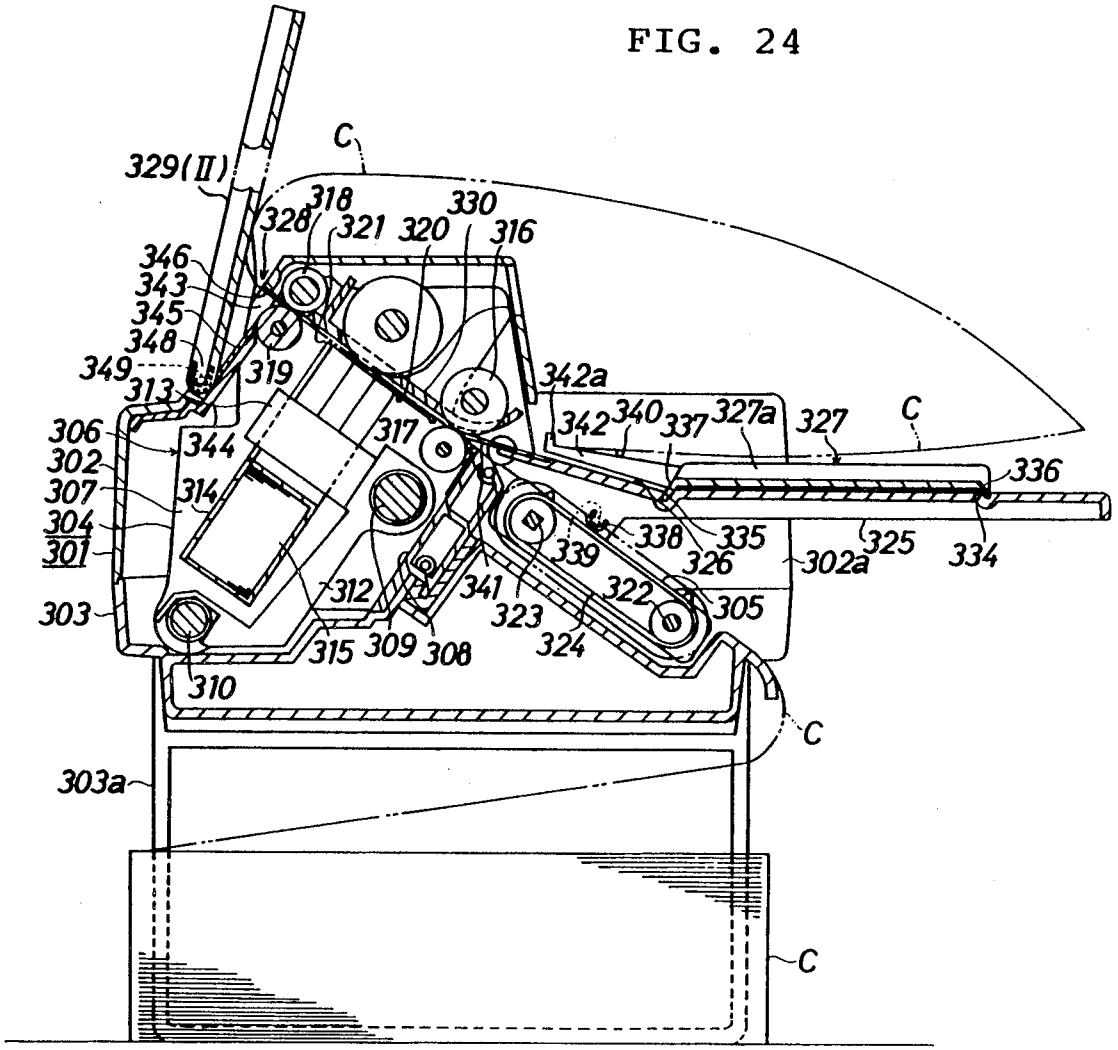
Figure 25:
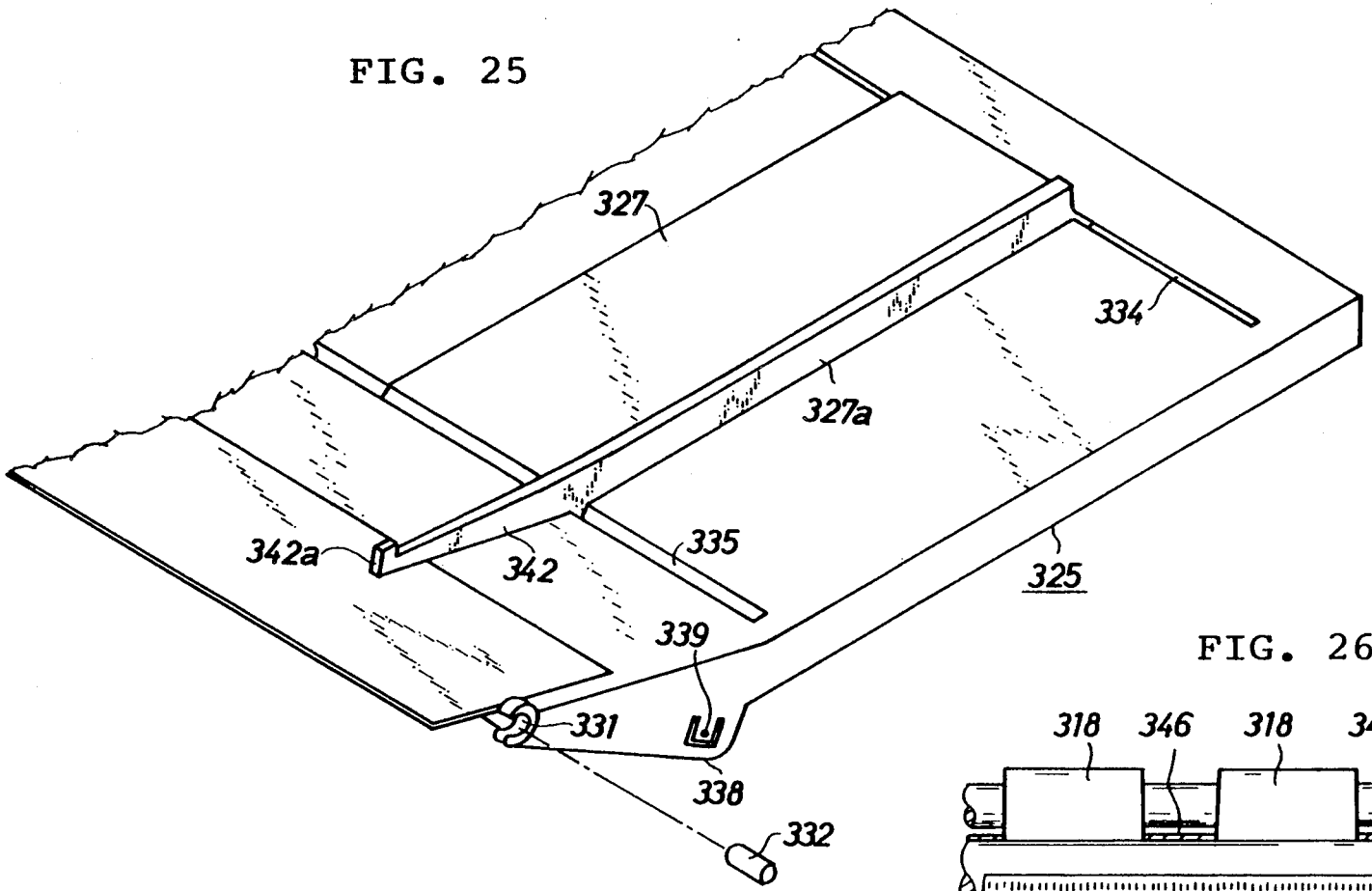
Figure 26:
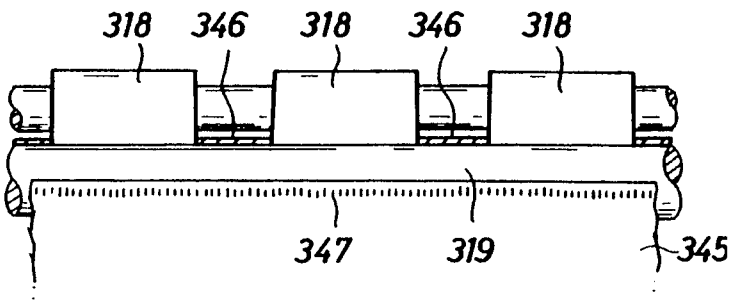
Figure 27:
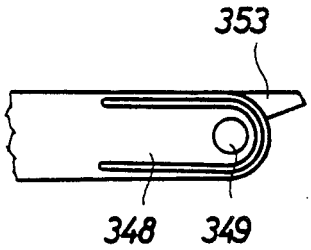
Figure 28:
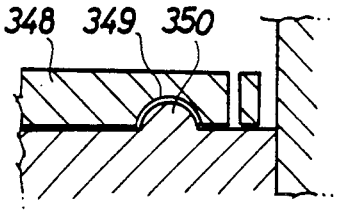
Figure 29:
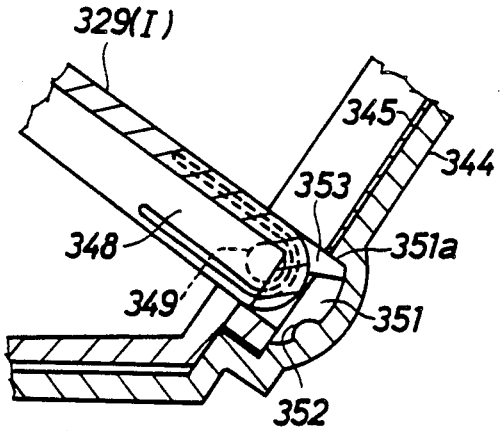
Figure 30:
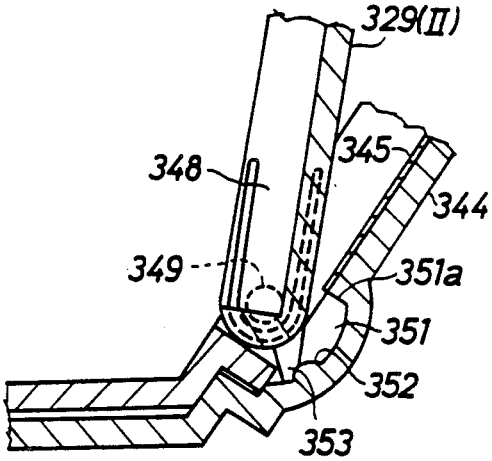

Finally, a third embodiment of the present invention will be described according to FIGS. 22 through 30 in which:

FIG. 22 is a perspective view of the printer in the third embodiment;

FIG. 23 is a longitudinal section of the printer which is printing an individual cut sheet of paper;

FIG. 24 is a longitudinal section of the printer which is printing a continuous web;

FIG. 25 is a partial perspective view illustrating a manual paper guide;

FIG. 26 is a partial sectional view illustrating a paper discharge portion;

FIGS. 27 and 28 are partial sectional views illustrating a rotatably supported structure of a paper tray;

FIG. 29 is a partial sectional view illustrating the paper tray shown in FIG. 23; and FIG. 30 is a partial sectional view illustrating the paper tray shown in FIG. 24.

DETAILED DESCRIPTION OF THE PREFERRED EMBODIMENTS

Hereinafter, a first embodiment of the present invention will be described in detail referring to the drawings.

Figure 1:
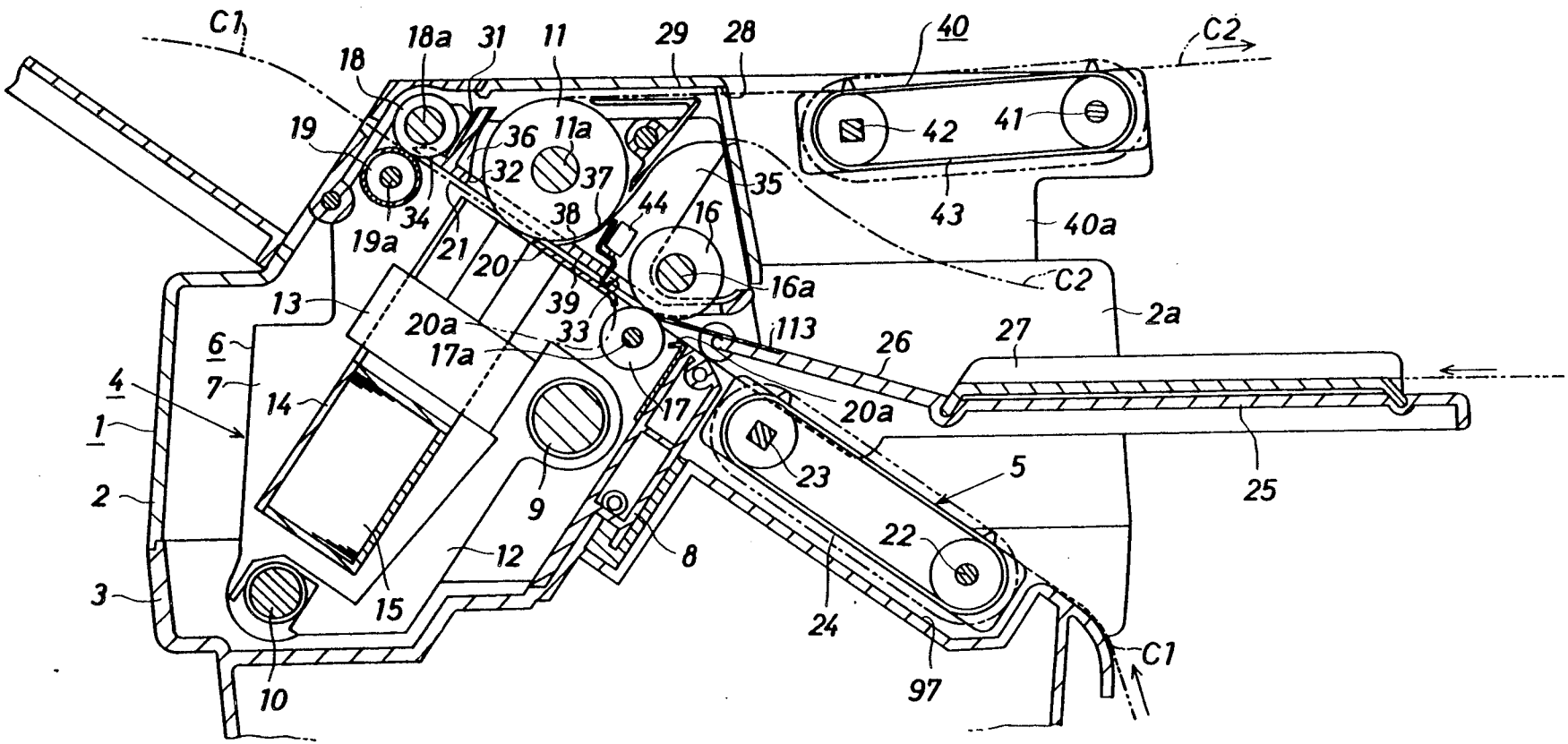
FIG. 1 is a longitudinal section of the main portion of the printer embodying the present invention.
Figure 16:
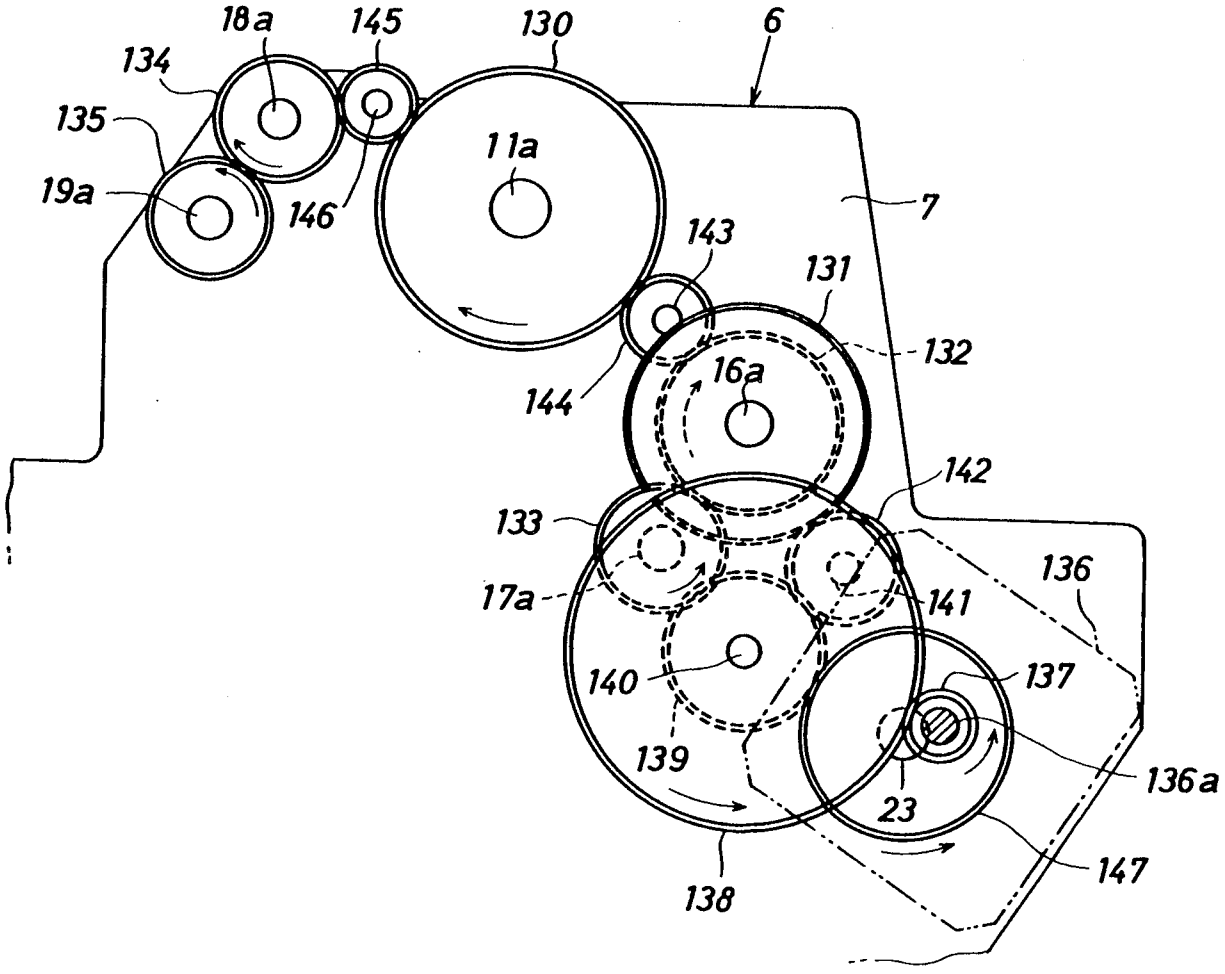
FIG. 16 is a side view of the gear mechanism in the printer.

Referring first to FIG. 1, a printer case 1 comprises an upper case 2 and a lower case 3 which are assembled together in the center of the printer case 1. A print mechanical unit 4 is disposed in the front side of the printer case 1 while a tractor unit 5 is disposed in the rear side thereof. A unit frame 6 of the print mechanical unit 4 includes a hollow horizontal bar 8 supported between a pair of side boards 7, and two round guide bars 9 and 10. A cylindrical platen 11 is rotatably supported between the side boards 7 and above the guide bars 9 and 10. As shown in FIG. 16, the platen 11 has a platen shaft 11*a* which is attached with a gear 130 at one end thereof.

A carriage 12 is supported between the guide bars 9 and 10 movably along the width of the printer, and in the upper portion of the carriage 12 a print head 13 is located so as to slant upward and face the platen 11 above it. A ribbon cassette 14 is disposed between the both side boards 7 of the unit frame 6 for feeding a print ribbon 15 in such a manner that a portion of the ribbon 15 is exposed from the ribbon cassette 14 to face the print head 13 opposite to a printing position on the platen 11. The carriage 12 moves along the width of the printer in such a manner that a sheet of paper is printed at the printing position on the platen 11 by means of the print head 13 via the print ribbon 15.

A pair of feeding rollers 16 and 17 and another pair of feeding rollers 18 and 19 are disposed at the front and the rear of the platen 11 respectively, and they are substantially on the tangent line of the printing position on the platen 11.

As shown in FIG. 16, the feeding roller 16 has a roller shaft 16*a* attached with a pair of gears 131 and 132 at one end thereof, the gear 131 being larger than the other gear 132. Similarly, roller shafts 17*a*, 18*a* and 19*a* of the feeding rollers 17, 18 and 19 are attached with their respective gears 133, 134 and 135 at their ends. A motor 136 in FIG. 16 is fixed on one of the side boards 7 and its drive shaft 136*a* is attached with a gear 137. Still another pair of gears 138 and 139 are attached to a shaft 140 in such a manner that the larger gear 138 is engaged with the gear 137 on the drive shaft 136*a* while the smaller gear 139 is connected with the larger gear 131 on the roller shaft 16*a* via an intermediate gear 142 on a shaft 141. Moreover, the smaller gear 132 on the roller shaft 16*a* is connected with the gear 130 on the platen shaft 11*a* via another intermediate gear 144 on a shaft 143. Still another intermediate gear 145 is attached to a shaft 146 so as to connect the gear 134 on the roller shaft 18*a* and the gear 130 on the platen shaft 11*a* to each other. The gear 134 on the roller shaft 18*a* and the gear 135 on the roller shaft 19*a* are connected to each other. Upon rotation of the motor 136, the feeding rollers 16, 17, 18, and 19, and the platen 11 are rotated in the paper feed direction so as to hold and advance the printing paper via the above-stated gear mechanism.

Referring again to FIG. 1, a paper path member 20 and a guide member 31 are disposed opposite to each other substantially on the lower side and the upper side, respectively, of the tangent line of the printing position on the platen 11. The paper path member 20, the guide member 31 and the feeding rollers 16 through 19 altogether form a paper guide path 21 passing through the printing position. The paper guide path 21 is substantially flat and slants upward to the paper feed direction so that the paper inlet side, namely, the side of the roller 16, is located lower than the paper discharging side, namely, the side of the roller 18.

The tractor unit 5 includes a guide shaft 22 and a transmission shaft 23 which extend in parallel to each other across the width of the printer. The tractor unit 5 also includes a pair of pin tractors 24 supported movably on the shafts 22 and 23 for adjustment across the width of the paper. The upper surface of each pin tractor 24 is disposed on the paper inlet side of the paper guide path 21 substantially in the same plane as the paper guide path 21 so that it slants upward to the paper feed direction. Like an ordinary printer of a similar kind, each pin tractor 24 comprises a pulley supported on the shafts 22 and 23, and a belt with pins which is wound around the pulley. The pins on the pin tractors 24 are engaged with pin feed holes spaced along the outer edge portion of a continuous web C1. As shown in FIG. 16, a gear 147 attached on the transmission shaft 23 is engaged with the smaller gear 139 on the shaft 140. As a result, when the motor 136 rotates the transmission shaft 23, the pin tractor 24 is accordingly rotated and the continuous web is guided into the paper guide path 21.

Referring again to FIG. 1, a manual guide plate 25 is supported between both side boards 7 of the unit frame 6 in the upper position relative to the tractor unit 5. On the upper surface of the manual guide plate 25, a guide plane 26 extends substantially horizontally so as to connected with the paper inlet portion of the paper guide path 21 at an obtuse angle. An individual cut sheet of paper manually inserted is guided into the paper guide path 21 along the guide plane 26 of the guide plate 25. A pair of sliding guides 27 are attached on the guide plate 25 movably along a perpendicular direction to the paper feed direction. The outer edges of the individual cut paper come into contact with the sliding guides 27 so as to guide the paper properly.

Figure 2:
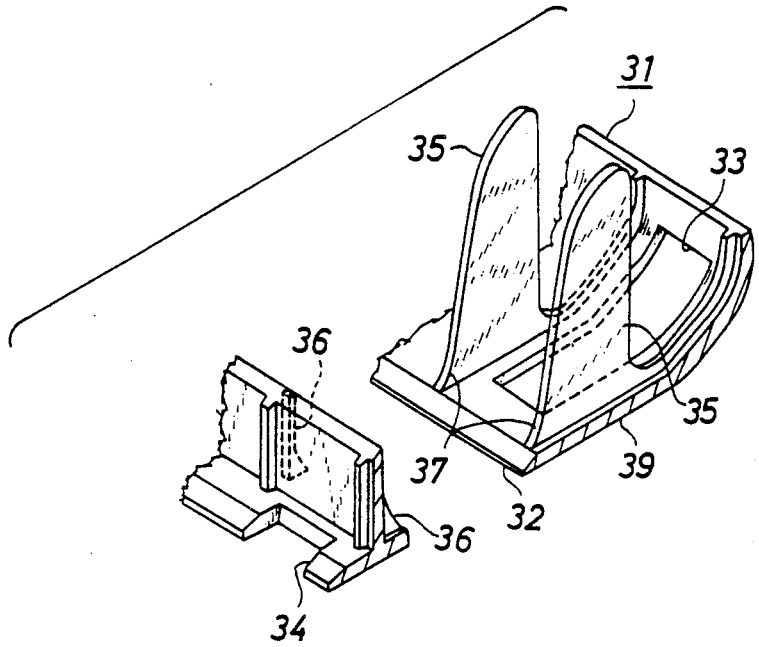
FIG. 2 is a partial perspective illustration of a guide member.

Now the above-mentioned parts or portions will be individually described in further detail according to FIG. 2 and the other attached drawings.

As shown in FIG. 2 in addition to FIG. 1, the guide member 31 is disposed close to the platen 11 and between both side boards 7 of the unit frame 6. The guide member 31 comprises an opening 32 which corresponds to the printing position on the platen 11, a plurality of slits 33 for permitting the feeding roller 16 therein, a plurality of cut portions 34 for permitting the feeding roller 18 therein, and ribs 35 and 36 which face each other on both sides of the opening 32. Many pairs of ribs 35 and 36 are disposed on the upper surface of the guide member 31 at a certain interval along the longitudinal direction of the platen 11.

A first guide plane 37 is formed along the inward surfaces of the ribs 35 and 36 and extends substantially in an arc around the circumference of the platen 11. The first guide plane 37 forms a first paper path 38 which extends around the platen 11 so as to guide the printing paper from the opposite side to the print head 13 and to discharge it from the opposite side to the print head 13. A second guide plane 39 extends along the lower surface of the guide member 31 and substantially on the tangent line of the platen 11. The second guide plane 39 forms a second paper path, namely, the upstream portion of the paper guide path 21.

Referring to FIG. 1, the paper path member 20 is made of a resilient plate. One end thereof on the upstream side of paper feed direction is fixed to the horizontal bar 8, and the other end thereof is located close to or in resilient contact with the platen's circumference. The paper path member 20 has a slit **20*a* so as to permit the feeding rollers 16 and 17** to come in contact with each other therein.

As shown in FIG. 1, a continuous web tractor device 40 is removably attached on the printer case 1 above the manual guide plate 25. The continuous web tractor device 40 includes a pair of frames **40*a*, a guide shaft 41, a drive shaft 42, and a pair of pin tractors 43. The right and left frames 40*a* are supported on the printer case 1 in the rear of the platen 11. Between the frames 40*a* the guide shaft 41 and the drive shaft 42 extend in parallel to each other across the width of the printer. The right and left pin tractors 43 are supported on the guide shaft 41 and the drive shaft 42 movably for adjustment across the width of the printing paper. The pin tractors 43 are designed in the same manner as the pin tractors 24. An opening 28 is provided at the back side of the upper case 2 in the rear of the platen 11. A path separation member 29 is provided between the opening 28 and the platen 11**.

A continuous web C2, which is different from that run on the other pin tractors 24, is inserted from the opening 28 and passes through the lower portion of the path separation member 29 and the first paper path 38, and then exits from the opening 28. Thereafter, the web C2 is engaged with the pin tractors 43 by the feed holes along its outer edge portions. When the web C2 is run on the pin tractors 43 as described above, the pin tractors 43 are rotated by the drive shaft 42 driven by a drive source such as a motor (not shown) installed at the side of the continuous web tractor device 40, or driven by the gear mechanism in connection with the platen 11, so as to draw out the continuous web C2.

When a conditions exists so that the continuous web tractor device 40 is installed and the continuous web C2 extends through the first paper path 38 toward the upper surface of the pin tractor 43 of the continuous web tractor device 40, it is possible to print out on the individual cut sheet of paper or another continuous web of paper C1 overlapping the continuous web C2. To elaborate, if the individual cut sheet of paper or the continuous web C1 is inserted in the second paper path 21 by means of the rotation of the platen 11 and the feeding rollers 16 through 19, the paper advances below the continuous web C2 which is previously set in the first paper path 38. Accordingly the inserted paper overlaps the continuous web C2 at the printing position on the platen 11. As a result, the paper overlapping the preset continuous web C2 is printed via the print head 13. In this case, the preset continuous web C2 in the first paper path 38 is advanced by the rotation of the platen 11. After the printed paper is drawn out, the preset continuous web C2 may be rolled back for the advanced length by manually rotating the platen 11 backward. Alternatively, if the continuous web C2 is allowed to have a blank space, it is possible to resume printing immediately without rolling back the continuous web.

In the first embodiment, a paper edge sensor 44 is installed between the platen 11 and the feeding roller 16, as shown in FIG. 1, so as to detect the front edge of the printing paper which is inserted into the second paper path 21. If a switch (not shown) is operated so as to select printing on the upper continuous web C2 overlapped by the lower continuous web C1 from the tractor unit 5, the motor 136 rotates reversely the platen 11, the feeding rollers 16 through 19, and the pin tractors 24 of the tractor unit 5. As a result, the lower continuous web C1 is rolled back from the printing position on the platen 11 until the paper edge sensor 44 detects the front edge of the lower continuous web C1. In response to the detection, the motor 136 rotates for a predetermined pulse and then stops rolling back the web C1. Thus, the front edge of the web C1 is held at a certain position between the pin tractors 24 and a pair of the feeding rollers 16 and 17. As a result of the roll-back of the lower continuous web C1, the opening 32 of the guide member 31 opens so that the upper continuous web C2 can be printed via the print head 13 at the opening 32. It is also possible to feed only the upper continuous web C2 by disconnecting the power transmission between the transmission shaft 23 and the feeding rollets 16 through 19, as described later.

If the above-mentioned switch is operated so as to select printing on the lower continuous web C1 from the tractor unit 5 on condition that the transmission shaft 23 is connected with the feeding rollers 16 through 19 in order to allow the power transmission between them, the motor 136 rotates the platen 11, the feeding rollers 16 through 19 and the pin tractors 24 to the normal direction so as to advance the lower continuous web C1. After the paper edge sensor 44 detects the front edge of the lower continuous web C1, the motor 136 rotates for a predetermined pulse and then stops feeding the web C1. As a result, the first printing line on the lower web C1 is disposed at the printing position on the platen 11 so that the lower continuous web C1 can be printed by means of the print head 13.

The aforementioned procedure for feeding the lower continuous web C1 back and forth can also be applied when the continuous web C1 or an individual cut sheet of paper is selectively inserted in the printing position without the upper continuous web C2 being set.

Figure 3:
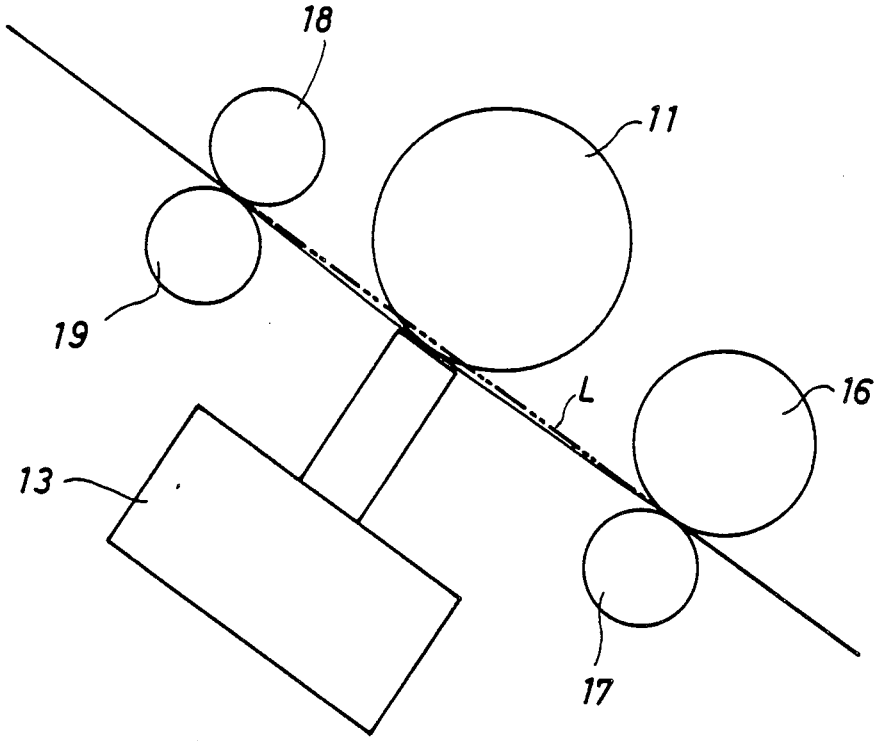
FIG. 3 is a schematic illustration for the relative arrangement of feeding rollers and a platen.

The disposition of the printing position on the platen 11 will be explained referring to FIG. 3. In the present embodiment, the printing position on the platen 11 is disposed a little closer to the print head 13 than to a straight line L connecting a pair of the feeding rollers 16 and 17 on the paper feeding side and the other pair of the feeding rollers 18 and 19 on the paper discharging side. Accordingly, the printer can feed a continuous web C1 from the tractor unit 5 or an individual cut sheet of paper from the manual guide plate 25 in such a manner that the inserted paper never fails to be in contact with the printing position on the platen 11 in the paper guide path 21. Therefore, the printing noise, resulting from the paper being free from the platen, can be reduced and noiseless printing is attained.

Figure 6:
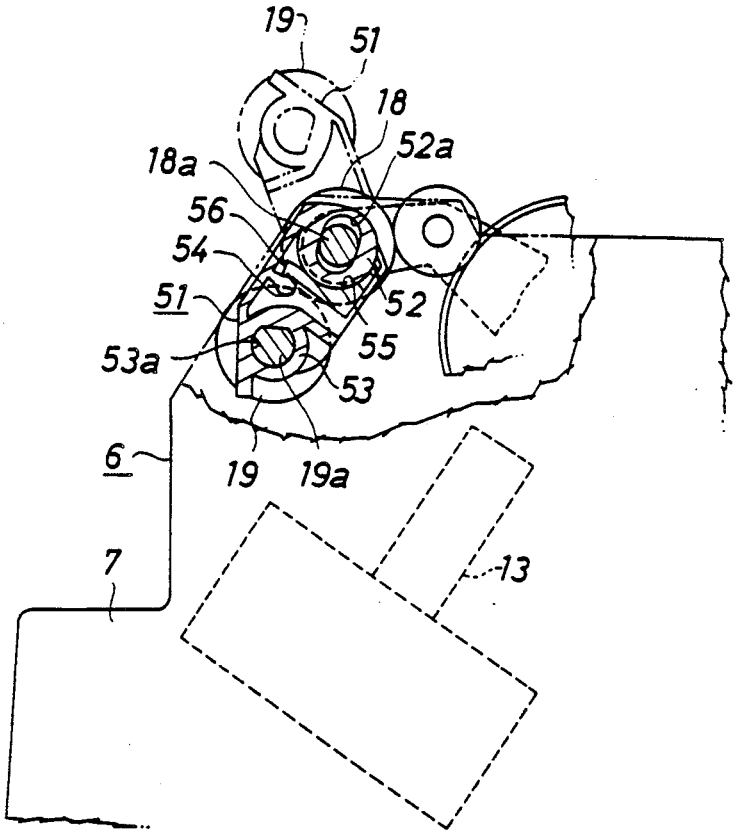
FIG. 6 is a partially cutaway sectional side elevation of the above construction.

Next, the structure of the feeding rollers 18 and 19 for discharging the paper will be described hereinafter. Referring to FIGS. 4, 5, and 6, a pair of arms 51 are provided for supporting the feeding rollers 18 and 19 on the side boards 7 of the unit frame 6. Each arm 51 has an upper boss 52 with a slot 52*a*, a lower boss 53 with a D-shaped slot 53*a*, and a connecting projection 54 between the bosses 52 and 53. Each end of the shaft 18*a* of the upper feeding roller 18 is rotatably and slightly movably supported through the slot 52*a* on the upper boss 52. The lower feeding roller 19 is made of a single hollow bar material. Each end of the roller 19 is affixed with the gear 135 which is rotatably supported around the peripheral surface of the shaft 19*a* extending through the center of the feeding roller 19. Each end of the shaft 19*a* is fixed in the D-shaped slot 53*a* on the lower boss 53.

As shown in FIG. 5, each inner surface of the side boards 7 of the unit frame 6 is provided with a curved recess 55 for rotatably supporting the upper boss 52 of the arm 51 thereon, and with a ratchet 56 which is connected or disconnected selectively with the connecting projection 54 of the arm 51. As shown in FIG. 6, when the upper boss 52 of the arm 51 is supported on the curved recess 55 and the connecting projection 54 is connected with the ratchet 56, the feeding rollers 18 and 19 are rotatably attached between the side boards 7.

The picture drawn by the continuous line in FIG. 6 illustrates the shaft 19*a* of the lower feeding roller 19 in its attached position. In this case, if the lower feeding roller 19 is pulled up in a diagonal direction, the connecting projection 54 of the arm 51 is removed from the ratchet 56 on the side board 7. Then, the arm 51 is rotated around the upper boss 52 which has been supported in the curved recess 55, and accordingly the lower feeding roller 19 is rotated around the shaft of the upper feeding roller 18 into a position shown by the chain double-dashed line in FIG. 6. Thus, the front direction of the printing position on the platen 11 is opened. This operation to remove the lower feeding roller 19 away from the print head 13 makes it easy to get rid of the stuck paper between the platen 11 and the print head 13, or to exchange the print head 13 with another.

Figure 7:
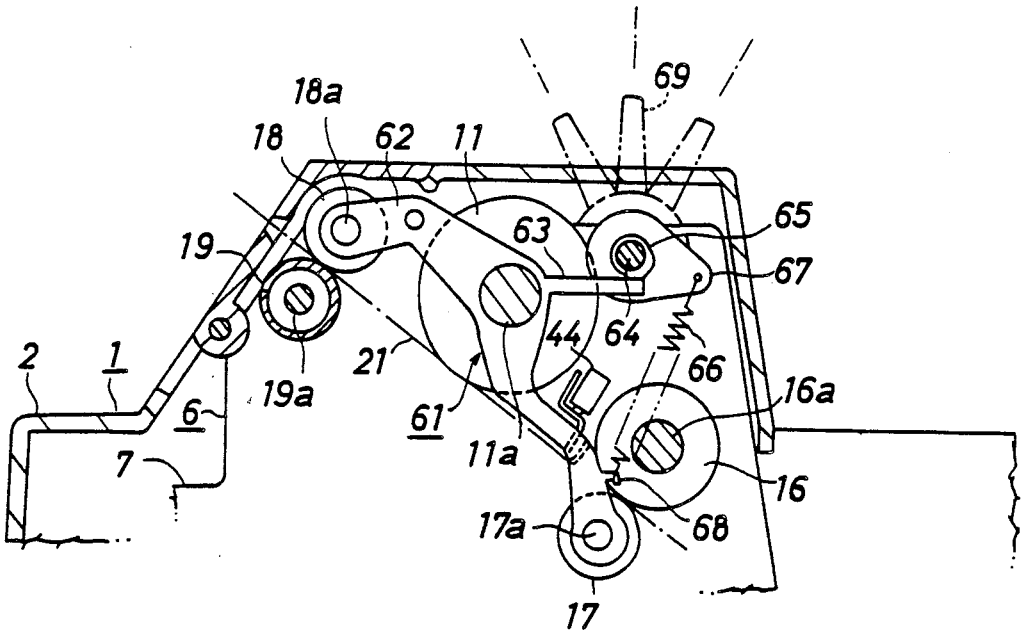
FIG. 7 is a partially sectional view of the alternation mechanism for altering the paper holding pressure by the feeding rollers.

Next, an alternation mechanism 61 will be explained, the alternation mechanism 61 being provided for altering the pressure by the feeding rollers 16 through 19 to hold the printing paper between them. Referring to FIG. 7, the alternation mechanism 61 comprises a support lever 62 whose center is rotatably supported on each end of the platen shaft 11*a*, and a press strip 63 which projects from the center of the support lever 62. On each end of the support lever 62 are rotatably attached the shafts 17*a* and 18*a* of the feeding rollers 17 and 18 which are opposite each other at the front and the rear, respectively, of the printing position on the platen 11, and also opposite each other above and below, respectively, the printing paper. Both ends of the shaft 16*a* of the feeding roller 16 are rotatably supported on the side boards 7.

The alternation mechanism 61 also comprises an operation shaft 64 rotatably supported between the side boards 7. A cam 65 is fixed on each end of the operation shaft 64 so that the cam 65 is connected with the press strip 63 on the support lever 62. A spring 66 is attached between a lever 67 of the operation shaft 64 and a tip 68 on the support lever 62. By means of the spring 66 the support lever 62 is pulled counterclockwise in FIG. 7. Therefore, the feeding rollers 17 and 18 for pressing the paper are pressed into contact with the feeding rollers 16 and 19, respectively. On the other hand, the operation shaft 64 is pulled clockwise in FIG. 7 by the spring 66 so that the cam 65 comes into contact with the press strip 63.

Figure 8:
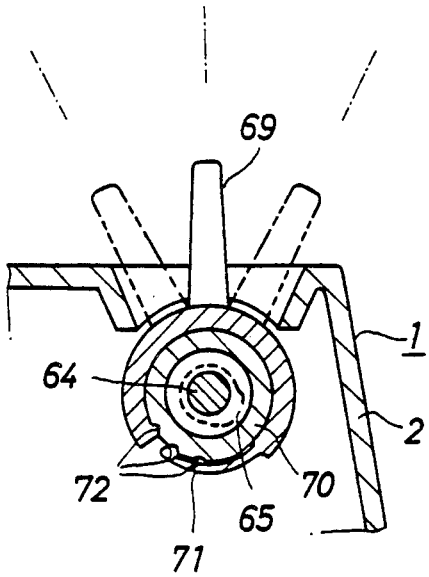
FIG. 8 is a partial sectional view enlarging the portion around an operation lever shown in FIG. 7.

Referring to FIG. 8 an operation lever 69 is rotatably supported around a support cylinder 70 on one of the side boards 7. The operation lever 69 is also fixed with one end of the operation shaft 64 at its center. The body portion of the operation lever 69 includes a resilient connecting pin 71 which is selectively engaged with one of three connecting recesses 72 provided around the peripheral surface of the support cylinder 70. Thus, the operation lever 69 is held at one of three operation positions shown by the symbols I, II, and III in FIGS. 7 and 8.

When the operation lever 69 is moved to the position I, a lower cam plane of the cam 65 is connected with the press strip 63 on the support lever 62. Accordingly, by means of the spring 66 the feeding rollers 17 and 18 made of rubber are partially deformed and pressed firmly against the feeding rollers 16 and 19, increasing the pressure to hold the paper between them.

When the operation lever 69 is moved to the position II, an intermediate cam plane of the cam 65 is connected with the press strip 63. Accordingly, the feeding rollers 17 and 18 are moved against the force of the spring 66 for a little distance in the opposite direction from the feeding rollers 16 and 19. In this case, the feeding rollers 17 and 18 are not deformed as much as in the case when the operation lever 69 is at the position I. Therefore, the feeding rollers 17 and 18 are slightly pressed to the feeding rollers 16 and 19, decreasing the pressure to hold the paper between them.

When the operation lever 69 is moved to the position III, a higher cam plane is connected with the press strip 63. As a result, the feeding rollers 17 and 18 are moved apart from the feeding rollers 16 and 19 and the paper is free from the pressure.

When the feeding roller 18 moves up and down as described above, the shaft 18*a* of the roller 18 moves up and down in the slot 52*a* on the arm 51 so as to keep the feeding roller 19 still. Accordingly, the gear 134 attached on the roller 18 also moves up and down as far as it remains engaged with the gear 135.

Now, examples for selecting the position of the operation lever 69 will be given hereinafter. If an individual cut sheet of paper is manually inserted from the manual guide plate 25 into the paper guide path 21, the operation lever 69 is moved to the position I so as to increase the pressure of the feeding rollers 17 and 18 to hold the paper. In this case, the printing paper is held firmly between the feeding rollers and advanced toward the paper feed direction by the rotation of the feeding rollers 16 through 19.

If a continuous web C1 is fed by the tractor unit 5, the operation lever 69 is moved to the position II so as to decrease the pressure to hold the paper. In this case, the continuous web C1 is fed smoothly without getting loose while sliding between the feeding rollers 16 through 19 which are rotated a little faster than the pin tractors 24 of the tractor unit 5.

If the paper gets stuck in the paper guide path 21, the operation lever 69 is moved to the position III so as to move the feeding rollers 17 and 18 away from the feeding rollers 16 and 19. As a result, the stuck paper is easily removed out of the paper guide path 21.

Figure 10:
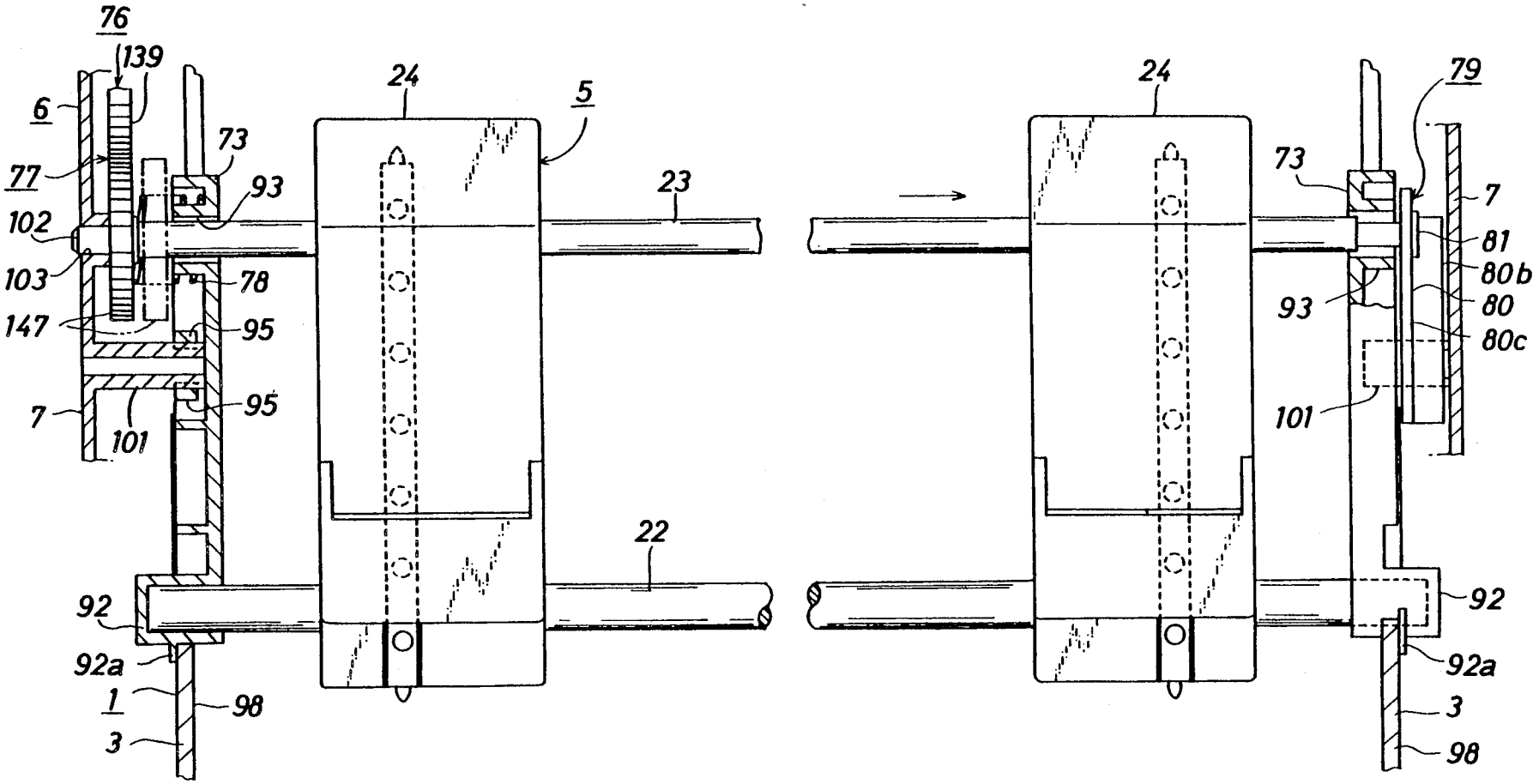
FIG. 10 is a partial enlarged transverse sectional view illustrating the support structure of the tractor unit, including the above interlock mechanism.

Hereinafter a description will be given for a mechanism for connecting or disconnecting the pin tractors 24 of the tractor unit 5 with the drive source of the feeding rollers 16 through 19 in synchronism with the alternation of the holding pressure by the operation lever 69 in the alternation mechanism 61. Referring to FIG. 10, the tractor unit 5 has a frame structure with a pair of tractor unit frames 73 which support both ends of the guide shaft 22. The tractor unit frames 73 are installed on the printer case 1 and on the print mechanical unit 4 so as to fix the tractor unit 5 in a certain position.

The transmission shaft 23 is supported between the tractor unit frames 73 rotatably and movably in the direction of the shaft line thereof. A power transmission mechanism 76 includes the gear 147 on the transmission shaft 23, the gear 139 disposed so as to be removably engaged with the gear 147, and plural gears provided between the transmission shaft 23 and the motor 136 for the drive source of the feeding rollers 16 through 19. Furthermore, in the present embodiment, a clutch mechanism 77 is provided for connecting and disconnecting the power transmission course by means of the gears 147 and 139 which are removably engaged with each other. Normally a spring 78 forces the transmission shaft 23 leftward in FIG. 10 so that the gear 147 is engaged with the gear 139 to maintain the clutch mechanism 77 in the connected state.

Figure 9:
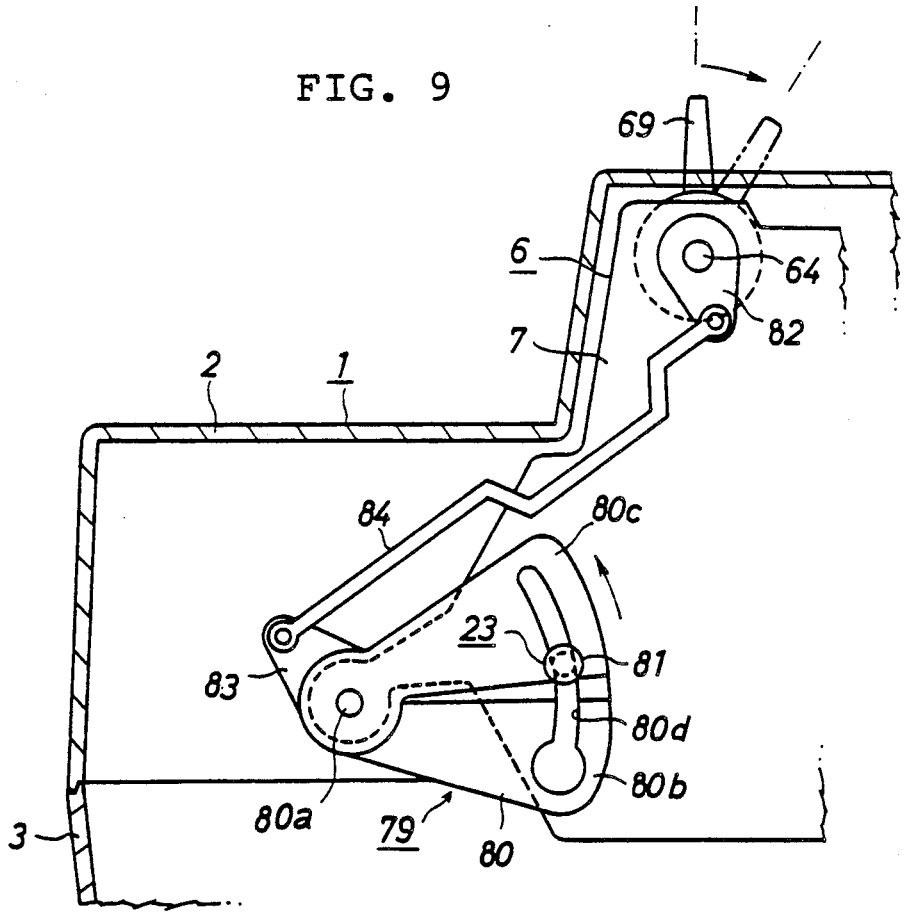
FIG. 9 is a partial sectional side elevation showing the interlock mechanism for connecting and disconnecting the tractor unit with the drive source in response to the alternation of the paper holding pressure.
Figure 17:
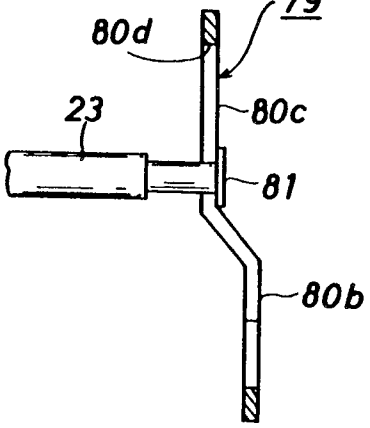
FIG. 17 is a section view of a side cam.

Referring to FIGS. 9 and 10, an operation means 79 is provided between the operation shaft 64 of the alternation mechanism 61 and the transmission shaft 23 of the tractor unit 5. The operation means 79 is operated in order to connect and disconnect the clutch mechanism 77 in synchronism with the operation mechanism 61. The operation means 79 comprises a side cam 80 supported on one of the side boards 7 rotatably around a shaft 80*a*. The outer cam plane of the cam 80 is engaged with an engaging pin 81 attached to the end of the transmission shaft 23 through a curved slot 80*d*. As shown in FIG. 17, the outer cam plane includes an upper cam plane 80*b* and a lower cam plane 80*c* which make a right angle relative to the rotating surface. Referring to FIG. 9, a rotating lever 82 is fixed at the opposite end of the operation shaft 64 from the operation lever 69. A link 84 is supported between the free end of the rotating lever 82 and a projection 83 projecting from the side cam 80.

An interactive operation of the alternation mechanism 61 and the clutch mechanism 77 will be described hereinafter. When the operation lever 69 is moved to the position II so as to decrease the holding pressure suitably for feeding a continuous web, the lower cam plane 80*c* of the side cam 80 is engaged with the engaging pin 81 of the transmission shaft 23 as shown in FIGS. 9 and 10. As a result, the clutch mechanism 77 is maintained in the connected state by means of the spring 78. On the other hand, when the operation lever 69 is moved to the position I so as to increase the holding pressure suitably for feeding an individual cut sheet of paper, the upper cam plane 80*b* of the side cam 80 is engaged with the engaging pin 81 of the transmission shaft 23. Accordingly, the transmission shaft 23 is moved rightward in FIG. 10, and the gear 147 is moved across the shaft line apart from the opposing gear 139 so as to put the clutch mechanism 77 into the disconnected state. Therefore, the present embodiment makes it possible to alter the pressure to hold the paper and to connect or disconnect the clutch mechanism synchronously.

Referring back to FIG. 1, when an individual cut sheet of paper is selected to be printed by operating the switch (not shown) instead of moving the operation lever 69 to the position I, the preset continuous web C1 is rolled back from the printing position on the platen 11 by reverse rotation of the feeding rollers 16 through 19 and the pin tractors 24, in the same manner as in the case when the continuous web tractor device 40 is used. Thereafter, in response to the detection of the paper edge sensor 44, the front edge of the continuous web C1 is stopped at a certain position between the feeding rollers 16 and 17 and the pin tractors 24. As a result, the clutch mechanism 77 is disconnected as described above and the power transmission to the pin tractors 24 is interrupted. Therefore, in printing the individual cut paper, the continuous web C1 is not fed wastefully as the individual cut paper is fed by the rotation of the feeding rollers 16 through 19.

Figure 11:
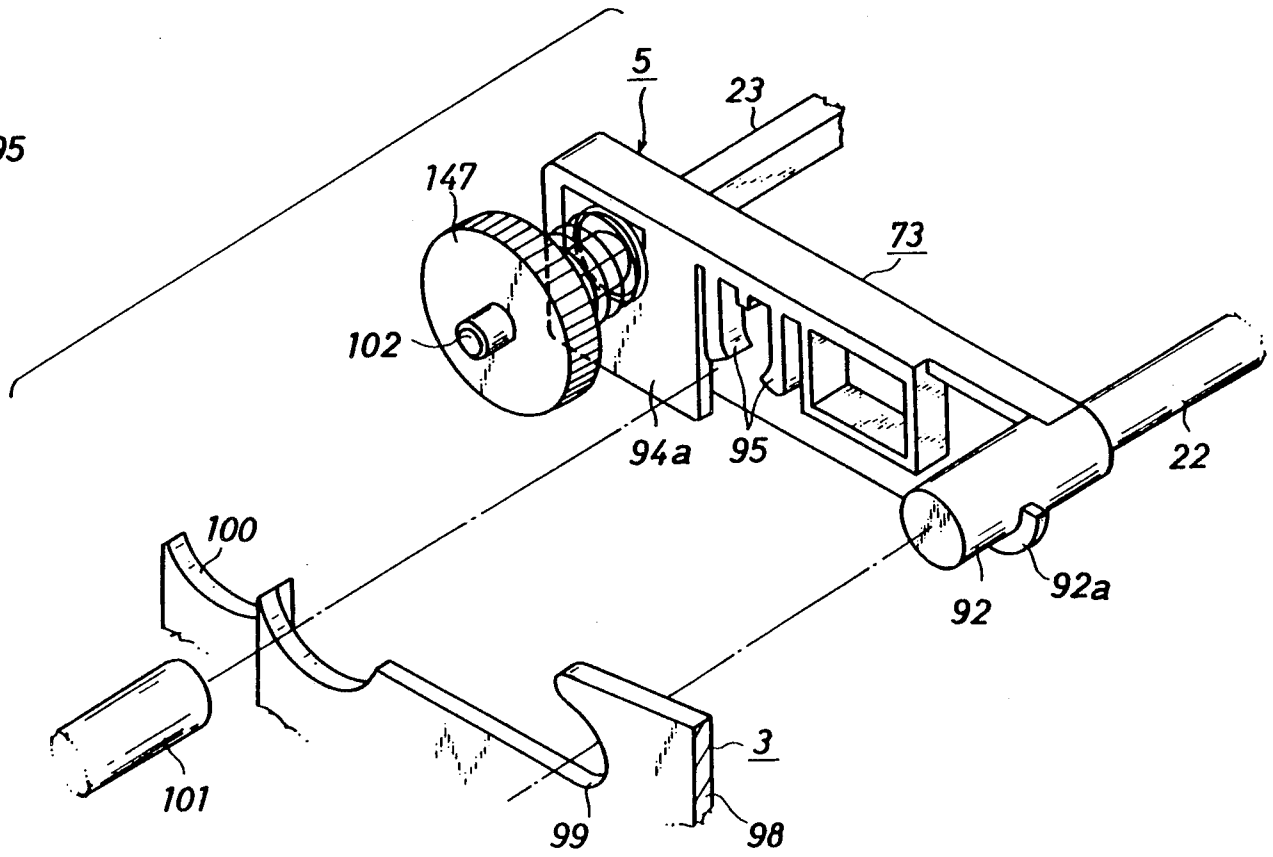
FIG. 11 is a partially exploded perspective view of FIG. 10.
Figure 12:
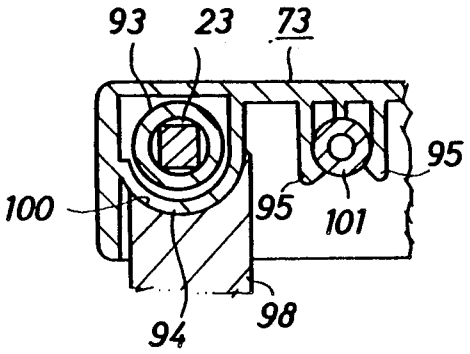
FIG. 12 is a partial sectional view of FIG. 11.

Now, the assembly of the tractor unit 5 installed in the printer case 1 will be explained with reference to FIGS. 10, 11, and 12. The tractor unit frame 73 has a projecting portion 92, a cylindrical boss 93, a circular wall 94 encompassing the boss 93, and a pair of engaging ratchets 95. The projecting portion 92 is disposed to support each end of the guide shaft 22 therein. The cylindrical boss 93 is disposed to support each end of the transmission shaft 23 therein. The engaging ratchets 95 are located between the projecting portion 92 and the wall 94. The lower case 3 of the printer case 1 has a receiver 97 for receiving the tractor unit 5 as shown in FIG. 1. Each of the rising walls 98, rising from the right and left sides of the receiver 97, has a broken portion 99 for supporting the projecting portion 92 at the end portion of the wall 98 apart from the print mechanical unit 4, and the broken portion 99 is open toward the unit 4. The rising wall 98 also includes a circular recess 100 disposed in contact with the circular wall 94. From the inner surface of the side boards 7 of the unit frame 6, an engaging pin 101 projects horizontally and inwardly over the rising wall 98 of the lower case 3 so that it is engaged with the engaging ratchets 95.

In order to assemble the tractor unit 5 in the printer case 1, first the projecting portion 92 of the tractor unit frame 73 is engaged in the broken portion 99 of the rising wall 98 of the lower case 3, and then the tractor unit frame 73 is rotated around the projecting portion 92 so as to put the opposite end from the projecting portion 92 into the receiver 97. As a result, the engaging ratchets 95 are resiliently engaged with the engaging pin 101 on the side board 7 of the unit frame 6. Then, the circular wall 94 of the tractor unit frame 73 is attached to the circular recess 100 of the rising wall 98. Thus, the tractor unit 5 is assembled in the receiver 97 of the lower case 3 in such a manner that the tractor unit 5 extends from the lower case 3 to the unit frame 6 as shown in FIG. 10.

The location of the tractor unit frame 73 in the back and forth direction, namely, the direction of the length of the print mechanical unit 4, is determined not by the projecting portion 92 or the circular wall 94 but by the engagement of the engaging pin 101 and the engaging ratchets 95. The location of the tractor unit frame 73 in the direction of the width, namely, the axial direction of the shafts 22 and 23, is determined by holding the rising walls 98 from both sides by means of a flange **92*a* on the projecting portion 92 and of a vertical wall 94*a* on the outer side of the circular wall 94**.

Therefore, as described above, the engaging ratchets 95 are engaged with the engaging pin 101 on the unit frame 6 so as to assemble the tractor unit 5 in a determined position easily as well as precisely. Similarly, the gear 147 provided at one end of the transmission shaft 23 is precisely engaged with the gear 139, namely, the last point of the transmission mechanism 76 starting from the motor 136 for driving the feeding rollers 16 through 19. In the present embodiment, a chamfer 102 is provided at the left end of the transmission shaft 23, as shown in FIG. 10, so as to be inserted smoothly into a hollow 103 of the side board 7. Accordingly, the transmission shaft 23 is disposed in the unit frame 6 more precisely.

Figure 13:
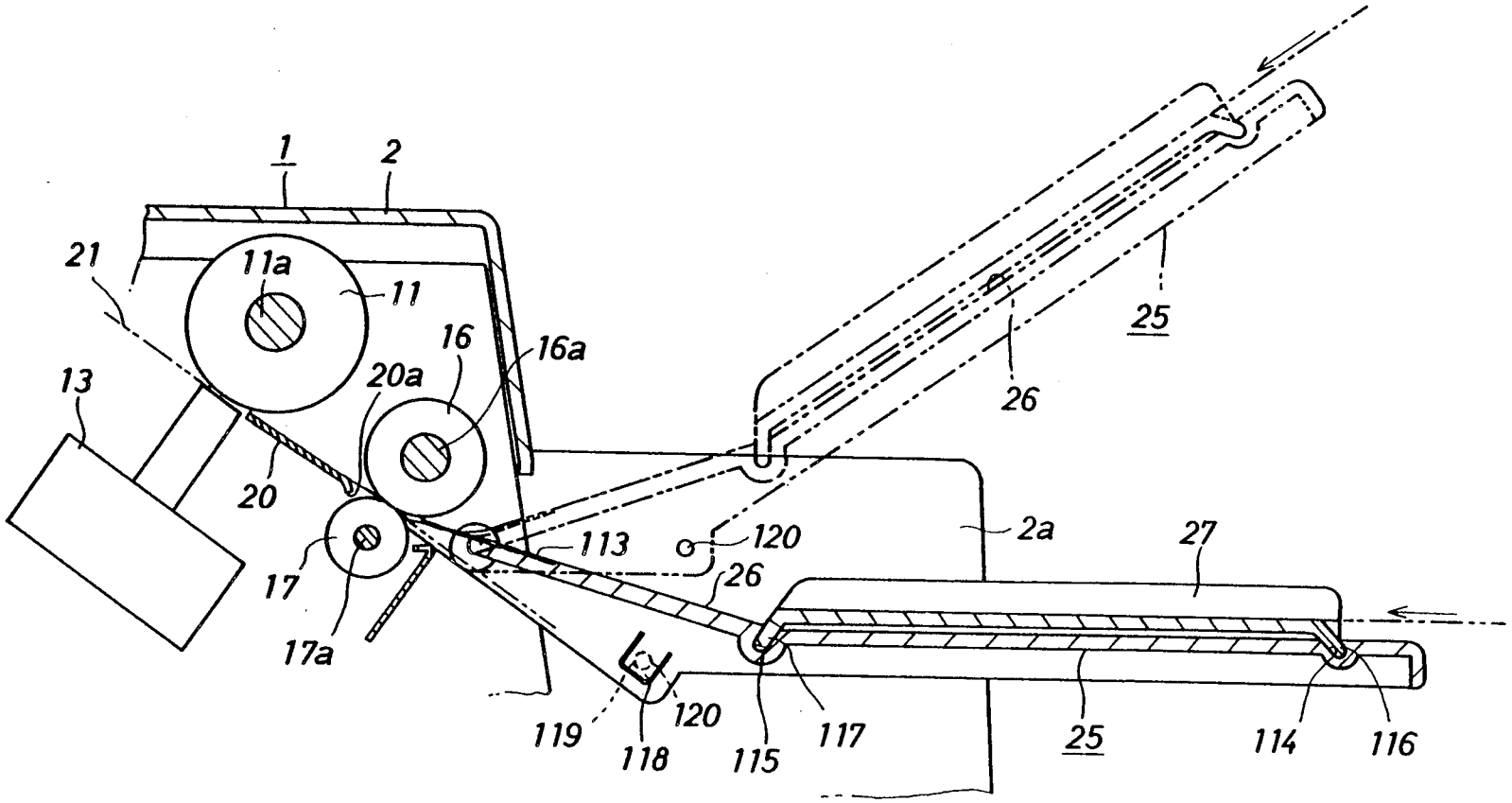
FIG. 13 is a partial sectional view illustrating mainly a manual paper guide plate.
Figure 14:
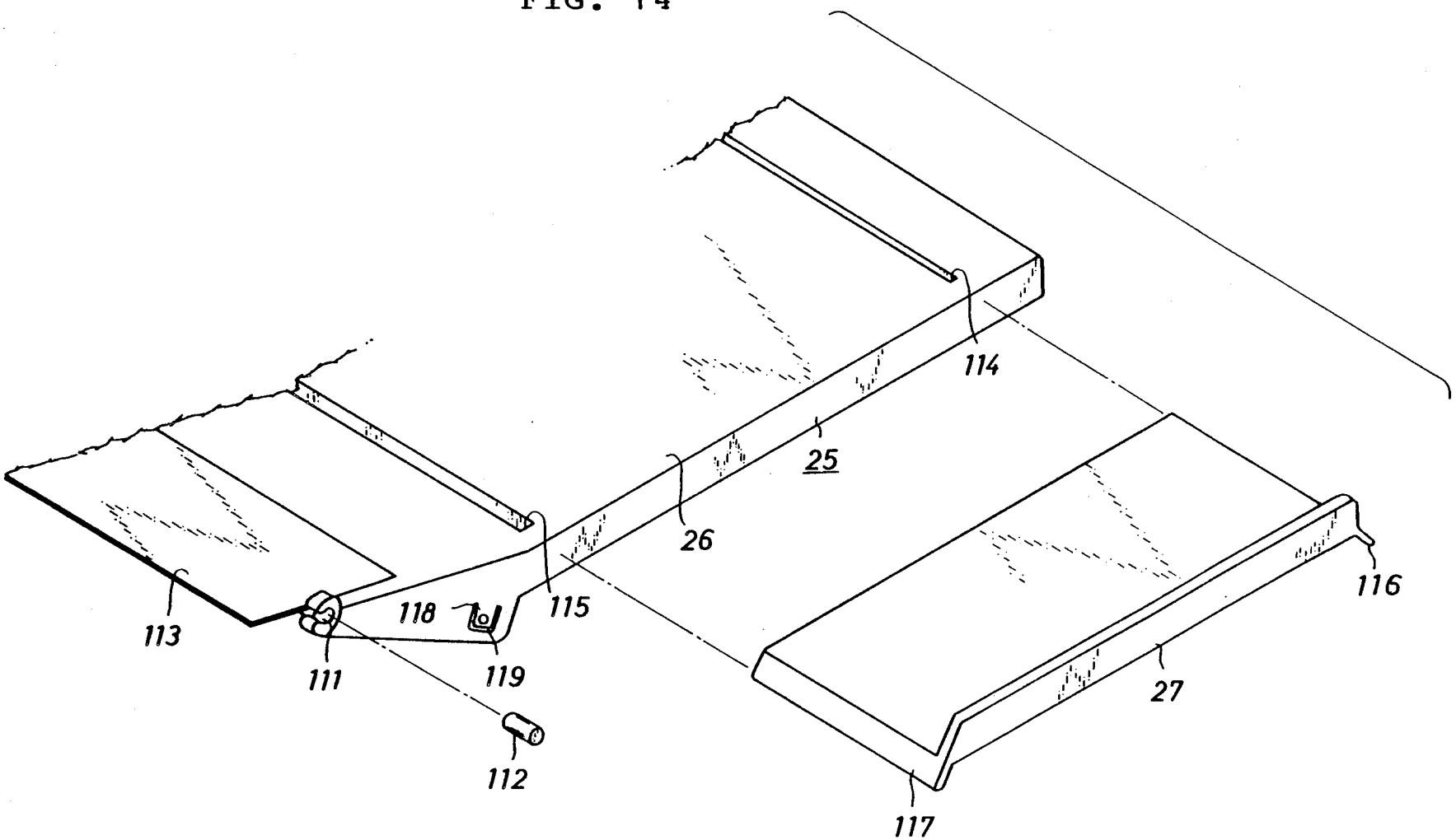
FIG. 14 is a partially exploded perspective view of the manual paper guide plate.

Referring to FIGS. 13 and 14, the structure of the manual guide plate 25 will be explained. The manual guide plate 25 is supported between the side boards 7 by removably engaging a hole 111 with a support pin 112, thereby being rotated around an axis which is parallel to an edge of the path member 20 at the paper inlet side. The hole 111 is provided on each side of the front portion of the manual guide plate 25, while the support pin 112 projects horizontally from the inner surface of the side board 7 of the unit frame 6. By rotating the manual guide plate 25, it is possible to change the angle of the guide plane 26 on the guide plate 25 in relation to the paper guide path 21 into one of the two predetermined angles. Each side of the manual guide plate 25 is also provided with a slit portion 118 which is formed with three sides being slit and which has resiliency in the sideward direction. The slit portion 118 includes a projection 119 projecting outward at the end portion of the slit portion 118. Upper and lower apertures 120 are provided on the inner surface of both side walls **2*a* of the upper case 2 standing by the guide plate 25. When the guide plate 25 is rotated in order to change its position, the projection 119 is selectively connected and disconnected with either of the two recessions 120 due to the resiliency of the slit portion 118, and accordingly the position of the guide plate 25** is determined selectively at one of the two positions.

If the guide plate 25 is positioned to extend almost horizontally, as shown by the solid line in FIG. 13, a thick individual cut form paper such as a postcard can be inserted from the guide plane 26 into the paper guide path 21 in such a manner that the paper is bent slightly. On the other hand, if the guide plate 25 is positioned to slant upward, as shown by the interrupted line in FIG. 13, a normal individual cut form paper, which is thinner than a postcard and able to be bend relatively sharp, can be inserted through the guide plane 26 by the operator standing in front of the printer, namely, at the left in FIG. 1, in the same manner as in the ordinary typewriters or the printers.

A resilient film 113 is attached at the end of the guide plate 25 and projects toward the paper guide path 21. The front edge of the resilient film 113 is touching or extremely close to the paper path member 20 which provides a base wall for the paper guide path 21. When the angle of the guide plane 26 relative to the paper guide path 21 is changed owing to the rotation of the guide plate 25, the resilient film 113 is bent in an arc while keeping in contact with the paper path member 20.

Therefore, the resilient film 113 facilitates insertion of the printing paper along the guide plane 26 and the upper surface of the resilient film 113 into the paper guide path 21 in both cases, namely; in one case when the guide plane 26 on the guide plate 25 meets the paper guide path 21 at a larger angle as shown by the solid line in FIG. 13, and in the other case when the guide plane 26 meets the paper guide path 21 substantially at a right angle as shown by the interrupted line in FIG. 13.

Furthermore, in the present embodiment, the tractor unit 5 is located below, the guide plate 25 as shown in FIG. 1, to feed the continuous web C1 into the paper guide path 21 in such a manner that the web C1 passes below the resilient film 113. As a result, the continuous web C1, in passing below the resilient film 113, is held under certain pressure between the resilient film 113 and the paper path member 20, and the continuous web C1 is provided with resistance to the feeding stream. Therefore, the continuous web C1 is kept in contact with the printing position on the platen 11, and furthermore the central part of the web C1 with respect to the width of the web is unlikely to become loose or depart from the printing position.

Next, the description will be given for the assembly of a sliding plate 27 on the guide plate 25. As shown in FIGS. 13 and 14, a pair of grooves 114 and 115 are provided in parallel to each other and orthogonally the paper feed direction on the upper surface of the guide plate 25. Both grooves 114 and 115 are grooved obliquely so that they are apart from each other the most at their bottoms. On the other hand, a pair of mount projections 116 and 117 project from the front edge and the rear edge, respectively, of the lower surface of the sliding guide 27. Both mount projections 116 and 117 project outward so that they are apart from each other the most at their edges.

Owing to the above-stated structure, the sliding guide 27 can be easily assembled on the guide plate 25 as follows. First, the sliding guide 27 is resiliently bent inward in the longitudinal direction. Then, the mount projections 116 and 117 of the sliding guide 27 are inserted in the grooves 114 and 115 on the guide plate 25, and thereafter the sliding guide 27 is flattened again so as to fit the mount projections 116 and 117 in the grooves 114 and 115. In this assembled state, the mount projections 116 and 117 are not likely to come off the grooves 334 and 335 undesirably since both the grooves and the mount projections extend outward. Furthermore, because of the accurate engagement of the grooves 114 and 115 with the mount projections 116 and 117, the sliding guide 27 can be smoothly slid on the guide plate 25 without being twisted, and disposed at a proper position for determining the width of the printing paper.

Next, the description will be given for an automatic paper feeding device 121 which is removably installed on the printer case 1 instead of the continuous web tractor device 40 shown in FIG. 1.

Figure 15:
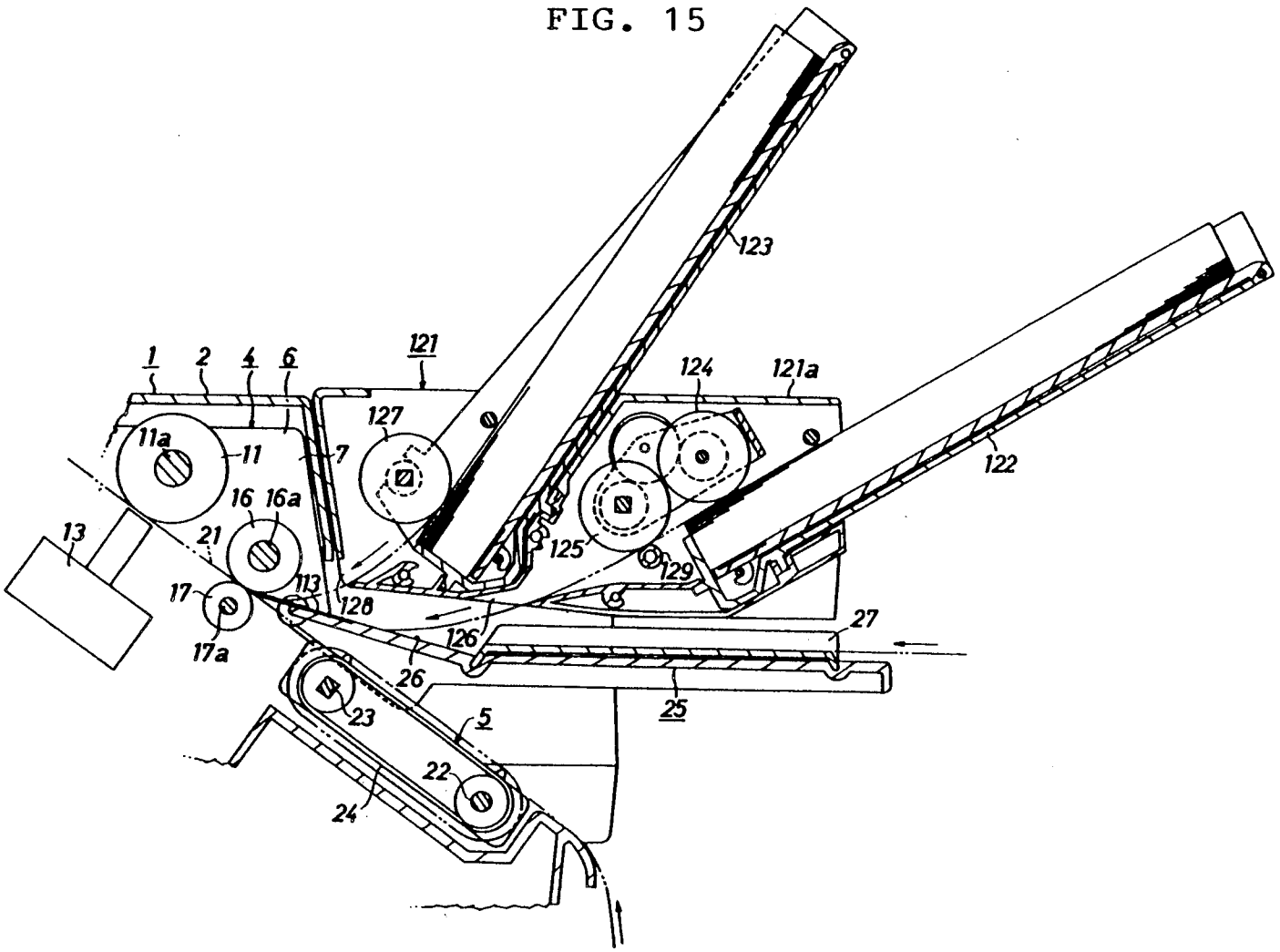
FIG. 15 is a partially longitudinal section of the printer installed with an automatic paper feeding device.

Referring to FIG. 15, the automatic paper feeding device 121 includes a flat box frame 121*a*, two stackers 122 and 123 supported aslant on the box frame 121*a*, and two feeding rollers 124 and 127 provided corresponding to the stackers 122 and 123 respectively. The individual cut form sheets stacked in the stackers 122 and 123 are lifted to the feeding rollers 124 and 127 by spring means (not shown). The top of those stacked sheets of paper is fed one after another due to rotation of the feeding rollers 124 and 127, in the same way as the ordinary automatic paper feeding device. A sheet of printing paper fed out from the rear stacker 122 is advanced toward the paper guide path 21 by rotation of rollers 125 and 129.

To elaborate, the detailed description of the automatic paper feeding device 121 is as follows. The box frame 121*a* is installed on the upper edges of both side walls 2*a* of the upper case 2 standing by the guide plate 25. The box frame 121*a* is disposed within the angle made by the paper guide path 21 and the manual guide plate 25; the paper guide path 21 being flat and slanting upward while the manual guide plate 25 being located almost horizontally. The stackers 122 and 123 are disposed respectively in different angular positions with respect to the guide plane 26. The individual cut form sheets of printing paper are stacked in the rear stacker 122 apart from the paper guide path 21. Those stacked sheets of paper are fed one after another as the feeding roller 124 is rotated, and then guided into the paper guide path 21 passing through an opening 126 and the guide plane 26; the opening 126 being open to the guide plane 26 at the bottom of the box frame 121*a*. On the other hand, the different individual cut sheets are stacked in the front stacker 123 near the paper guide path 21. Those stacked sheets of paper are fed one after another as the feeding roller 127 is rotated, and then guided into the paper guide path 21 passing through an opening 128 which is open at the front edge of the box frame 121*a*.

Therefore, the printer of the present embodiment does not need the troublesome exchange of the automatic paper feeding device 121 and the manual guide plate 25 by removing one for the other. The automatic paper feeding device 121 and the manual guide plate 25 respectively connect with the paper guide path 21, and the paper feeding device 121 is disposed above the manual guide plate 25. Accordingly, it makes it easy and efficient to print out continuously on the stacked sheets of paper automatically and to print out on the manually inserted sheets of paper.

Referring to FIG. 15, as described before, the printer of the present embodiment includes the tractor unit 5, as the pin tractor means, slanting under the guide plate 25 in the same direction as the paper guide path 21. The end of the tractor unit 5 near the paper guide path 21 is disposed adjacent to the lower surface of the guide plate 25. As a result, the tractor unit 5 can be selectively used in order to start printing out on the continuous web C1 immediately instead of on the above-mentioned two kinds of individual cut form paper. In this case, the continuous web C1, fed from the tractor unit into the paper guide path 21, is brought into contact with the lower surface of the guide plate 25 so that the printing paper is not likely to leave its course.

As described hereinbefore, the first embodiment of the present invention makes it possible to feed a manually inserted sheet of paper along a paper guide path having a relatively large radius instead of a small radius which will cause the sheet to be bent hard around it. Furthermore, the first embodiment also makes it possible to feed a continuous web almost straight into the printing position in order to prevent paper clogging.

Hereinafter, a second embodiment of the present invention will be described in detail with reference to the drawings.

As shown in FIG. 19, a platen 202 is located in a printer 201 and two pairs of feeding rollers 203 are provided in the front and the rear of the platen 202 respectively. A print head 204 slants below the platen 202 so as to face the platen 202. The print head 204 moves across the printing line on the platen 202 in order to print out the lower surface of the printing paper. A paper inlet portion 205 and a paper discharge portion 206 are provided on both sides of the printing position below the platen 202. The paper discharge portion 206 is located at an upper position than the paper inlet portion 205 so that they form a paper guide path 214 which is slanting and flat.

As shown in FIGS. 18, 19, and 20, a pair of leg portions 207 project from both lower edges of the printer 201 and they have a stock space 208 for storing a continuous web P1 between them. The paper inlet portion 205 comprises a wall 205*a* substantially on the same plane as the paper guide path 214. A pin tractor 209 is located in a recess provided in the middle part of the wall 205*a*. The pin tractor 209 has a number of pins which are engaged in pin feed holes on both outer edges of the continuous web P1. Therefore, the pin tractor 209 can feed the continuous web P1 from the stock space 208 into the printing position below the platen 202.

A guide plate 210 for a paper feeding guide is disposed above the pin tractor 209. To elaborate, the guide plate 210 is located at the rear portion of the printer 201, that is, in a space which extends rearward and upward between a pair of walls 201*b* rising from both sides of the paper inlet portion 205, as shown in FIG. 18. The guide plate 210 is attached to the walls 201*b* at its end portion which is adjacent to the upper part of the wall 205*a*, so that the guide plate 210 can be rotated around a shaft 215, as shown in FIG. 19. Each side of the guide plate 210 is provided with a protrusion 216 which is selectively engaged with an upper recess 217 and a lower recess 218 on the wall 201*b*. Accordingly, the guide plate 210 is selectively positioned into the horizontal state illustrated by the solid line in FIG. 19 and into the slanting state illustrated by the interrupted line. An individual cut sheet of paper P2 is inserted one after another along the upper surface of the guide plate 210 into the printing position.

Referring now to FIGS. 20 and 21, in the paper inlet portion 205, an automatic paper feeding device 221 is removably installed above the rear portion of the printer 201 so as to feed the individual cut sheets P2. The automatic paper feeding device 221 has a pair of side frames 221*a* removably disposed on the walls 201*b*. A paper stacker 224 is located between the side frames 221*a*. In order to feed the individual cut sheets P2 on after another from the paper stacker 224, a feeding roller 222 is disposed so as to face the lower portion of the paper stacker 224. Below the feeding roller 222, a guide plate 223 is located at an obtuse angle with the paper guide path 214 so as to insert smoothly the individual cut sheets P2 one after another in the paper inlet portion 205. An insert slit 225 for manual insertion of the individual cut sheets P2 is formed between a lid 221*b* over the feeding roller 222 and another lid 201*d* over the platen in the printer 201. The insert slit 225 is connected with the paper guide path 214.

The paper discharge portion 206, on the other hand, has a window 211 including a transparent plate. On the upper portion thereof, a reverse guide plate 219, made of a transparent plate, is attached by means of a hinge 220 which is provided on each lower side of the reverse guide plate 219. Accordingly, the reverse guide plate 219 can rotate around an axis which is parallel to the printing line on the platen 202. A paper discharge slit 212 is formed by the upper edge of the window 211 and the lower edge of the reverse guide plate 219. As shown in FIGS. 19 and 20, the paper discharge slit 212 is located substantially on the extended line of the paper guide path 214 which extends almost straight from the paper inlet portion 205 to the paper discharge portion 206 via the printing position. Furthermore, the paper discharge slit 212 extends narrowly in parallel with the printing line on the platen 202.

As shown in FIGS. 19, 20, and 21, a printed paper stacker 213 is fixed on the outer side of the printer 201. Referring to FIG. 18, the upper surface of the printer 201 comprises a pair of holes 201*a* adjacent to the lower edge of the window 211. On the other hand, the connecting portion of the printed paper stacker 213 comprises a pair of projections 213*a* shown in FIGS. 19 and 20. Thus, the printed paper stacker 213 is connected with the printer 201 by engaging the projections 213*a* with the holes 201*a*. The upper surface of the printed paper stacker 213 is located substantially in parallel to the extended line of the paper guide path 214. As a result, the printed individual cut sheets P2 are discharged from the paper discharge slit 212 and then stacked upward one after another in the stacker 213.

In the case of printing the continuous web P1, on the other hand, the printed continuous web is discharged over the upper edge of the window 211 and then stacked in front of the printer 201, as shown in FIG. 19. The function of the reverse guide plate 219 will be described in detail hereinafter. The reverse guide plate 219 is bent at the middle of it so that it divided into two parts, i.e., an upper part extending along the upper surface of the printer 201 and a front part extending along the front side of the printer 201. When the reverse guide plate 219 is positioned in the non-reverse state, that is; when the reverse guide plate 210 is in contact with both the upper surface and the front surface of the printer 201 as shown by the solid line in FIG. 19, the paper discharge slit 212 is formed between the reverse guide plate 219 and the window 211 so as to feed out the printed paper onto the printed paper stacker 213 via the paper discharge slit 212. On the other hand, when the reverse guide plate 219 is positioned into the reversing state, that is; when the reverse guide plate 219 is rotated around the hinge 220 to be apart from the printer 201 as shown by the interrupted line in FIG. 19, the reverse guide plate 219 is on the extended line of the paper guide path 214. In this case, the printed paper is discharged over the upper edge of the window 211 which corresponds to the paper discharge slit 212 in the non-reverse state of the reverse guide plate 219. Then, the printed paper is reversed along the inner surface of the reverse guide plate 219.

As shown in FIGS. 18 and 21, the printer 201 comprises a manual switch panel 201*c* for controlling the printing operation at one longitudinal edge on the upper surface of the printer 201.

Now, with reference to FIG. 20, a first example of paper feeding in the second embodiment will be given as concerns when the individual cut sheets of paper P2 of normal thin type are printed automatically in succession. The paper guide plate 210 is positioned horizontally, and the automatic paper feeding device 221 is attached on the printer 201. Then, the reverse guide plate 219 is disposed in the non-reverse state. As a result, the printed sheets of paper P2 are fed by the feeding roller 222 one after another and guided smoothly into the paper guide path 214 by means of the guide plate 223 which makes an obtuse angle with the paper guide path 214. Thereafter, the printing paper P2 is advanced toward the print head 204 by which the lower surface of the paper P2 is printed. The individual cut sheets P2, which have been printed as described above, are discharged one after another from the paper discharge slit 212 in the paper discharge portion 206, and then stacked on the printed paper stacker 213 with the printed side facing downward. Thus, the printed sheets of paper P2 are stacked in a normal page order, and it is not necessary to arrange the whole pages backward to be in a proper page order after printing.

Now, a second example of paper feeding in the second embodiment will be given as concerns when an individual cut sheet P2 of normal thin type is inserted by hand. If the automatic paper feeding device 221 is attached on the printer 201 as shown in FIG. 21, the sheet of paper P2 can be inserted from between the lid 201*d* and the other lid 221*b*. If the automatic paper feeding device 221 is not attached, on the other hand, the paper guide plate 210 is rotated into its slanting position shown by the interrupted line in FIG. 19. The operator, standing in parallel to the platen 202 and in front of the printed paper stacker 213, inserts an individual cut sheet of paper P2 in such a manner as dropping it along the upper surface of the paper guide plate 210. The front edge of the inserted paper P2 is guided toward the paper guide path 214 by means of the wall 205*a*. Accordingly, the printing paper P2 can be fed smoothly into the printing position.

Next, a third example of paper feeding in the second embodiment will be given as concerns when an individual cut piece of paper P2 of thick type is inserted by hand. The paper guide plate 210 is disposed in its horizontal position shown by the solid line in FIG. 19 so that the paper P2 is inserted along the upper surface thereof. The paper P2 inserted from the paper guide plate 210 is not guided around the platen's peripheral surface but guided substantially straight toward the paper discharge portion 206 via the printing position below the platen 202. As a result, a thick piece of paper such as a postcard is not bent hard due to rotation around the platen 202. It is also possible to execute printing out on this kind of thick paper with the automatic paper feeding device 221 attached on the printer 201 as shown in FIG. 20.

Finally, a fourth example of paper feeding in the second embodiment will be given as concerns when the continuous web P1 is printed. In this example, the reverse guide plate 219 is disposed in the reversing state. The continuous web P1 stored in the stock space 208 is drawn out by the pin tractor 209 and advanced toward the printing position through the paper guide path 214. When discharged from the paper discharge portion 206, the printed continuous web P1 is reversed by the reverse guide plate 219 into the direction of the paper inlet portion 205. Thus, the printed continuous web P1 can be stacked on the side of the paper inlet portion 205 and next to the printing paper P1 which is ready to be printed in the stock space 208. Accordingly, it is convenient for the operator since it allows him or her to handle the paper which is to be printed as well as the paper which has been printed, standing on the same side of the printer.

Furthermore, since the printer comprises the manual switch panel 201*c* on the upper surface of the printer 201, it is still easy for the operator to operate the printer even when he or she stands by the edge of the printer near the manual switch panel 201*c* or stands in front of the paper guide plate 210.

Hereinafter, a third embodiment of the present invention will be described in detail referring to the drawings.

Referring first to FIGS. 22, 23 and 24, a printer case 301 comprises an upper case 302 and a lower case 303 which are assembled together in the center of the printer case 301. A leg portion 303*a* is attached on each sideward edge of the lower surface of the lower case 303. A print mechanical unit 304 is disposed in the front side of the printer case 301 while a tractor unit 305 is disposed in the rear side thereof. A unit frame 306 of the print mechanical unit 304 includes a hollow horizontal bar 308 supported between a pair of side boards 307, and two round guide bars 309 and 310. A cylindrical platen 311 is rotatably supported between the side boards 307 and above the guide bars 309 and 310.

A carriage 312 is supported between the guide bars 309 and 310 movably along the width of the printer, and in the upper portion of the carriage 312 a print head 313 is located so as to slant upward and face the platen 311 above it. A ribbon cassette 314 is disposed between the both side boards 307 of the unit frame 306 for feeding a print ribbon 315 in such a manner that a portion of the ribbon 315 is exposed from the ribbon cassette 314 to face the print head 313 opposite to the printing position on the platen 311. The carriage 312 moves along the width of the printer in such a manner that a sheet of paper is printed at the printing position on the platen 311 by means of the print head 313 via the print ribbon 315.

A pair of feeding rollers 316 and 317 and another pair of feeding rollers 318 and 319 are disposed at the front and the rear of the platen 311 respectively, and they are substantially on the tangent line of the printing position on the platen 311. Upon rotation of the motor.(not shown), the feeding rollers 316, 317, 318, and 319, and the platen 311 are rotated to the paper feed direction via the gear mechanism (not shown) so as to hold and advance the printing paper.

A paper path member 320 and a guide member 330 are disposed opposite to each other substantially on the lower side and the upper side, respectively, of the tangent line of the printing position on the platen 311. The paper path member 320, the guide member 330 and the feeding rollers 316 through 319 altogether form a paper guide path 321 passing through the printing position. The paper guide path 321 is substantially flat and slants upward to the paper feed direction so that the paper inlet side, namely, the side of the roller 316, is located lower than to the paper discharging side, namely, the side of the roller 318. After printed at the printing position, the printing paper is discharged from a paper discharge portion 328, namely, from the feeding rollers 318 and 319 and then a window slit 343, slanting upward out of the printer case 301.

The tractor unit 305 includes a guide shaft 322 and a transmission shaft 323 which extend in parallel each other across the width of the printer. The tractor unit 305 also includes a pair of pin tractors 324 supported movably on the shafts 322 and 323 for adjustment across the width of the paper. The upper surface of each pin tractor 324 is disposed on the paper inlet side of the paper guide path 321 substantially in the same surface as the paper guide path 321 so that it slants upward to the paper feed direction. Like an ordinary printer of a similar kind, each pin tractor 324 comprises a pulley supported on the shafts 322 and 323, and a belt with pins which is wound around the pulley. A continuous web C is piled between the two leg portions 303*a* below the printer case 301. The pins on the pin tractors 324 are engaged with pin feed holes spaced along the outer edge portion of the continuous web C. As a result, when the motor (not shown) rotates the transmission shaft 323, the pin tractor 324 is accordingly rotated and the continuous web C is guided into the paper guide path 321.

The tractor unit 305 and the feeding rollers 316 and 317 cooperate so as to feed the continuous web C toward the printing position.

A manual guide plate 325 is supported between both side boards 307 of the unit frame 306 in the upper position relative to the tractor unit 305. On the upper surface of the manual guide plate 325, a guide plane 326 extends substantially horizontally and crosses the paper guide path 321 at a predetermined angle. An individual cut sheet of paper S manually inserted is guided into the paper guide path 321 along the guide plane 326 of the guide plate 325. A pair of sliding guides 327 are attached on the guide plate 325 movably along a perpendicular direction to the paper feed direction. The outer edges of the individual cut paper S come into contact with the sliding guides 327 so as to be guided properly.

The paper discharge portion 328 includes a paper tray 329 outward, on which the printed paper S is piled.

Next, the manual guide plate 325 will be described in further detail. Referring to FIG. 25, the manual guide plate 325 is rotatably supported between the side boards 307 by removably engaging a hole 331 with a support pin 332. The hole 331 is provided on each side of the front portion of the manual guide plate 325, while the support pin 332 projects horizontally from the inner surface of the side board 307 of the unit frame 306. By rotating the manual guide plate 325, it is possible to change the angle of the guide plane 326 on the guide plate 325 in relation to the paper guide path 321. Each side of the manual guide plate 325 is also provided with a slit portion 338 which is formed with three sides being slit and which has resiliency in the sideward direction. The slit portion 338 includes a projection 339 projecting outward at the end portion of the slit portion 338. As shown in FIGS. 23 and 24, upper and lower apertures 340 are provided on the inner surface of both side walls 302*a* of the upper case 302 standing by the guide plate 325. When the guide plate 325 is rotated in order to change its position, the projection 339 is selectively connected and disconnected with either of the two recessions 340 due to the resiliency of the slit portion 338, and accordingly the position of the guide plate 325 is determined selectively at one of the two positions.

Referring now to FIG. 23, if the guide plate 325 is positioned to slant upward, as shown by the solid line in FIG. 23, an individual cut sheet of paper S of normal type, i.e., thinner than a postcard and able to be bend relatively sharp, can be inserted through the guide plane 326 by the operator standing in front of the printer, namely, at the left in FIG. 23, in the same manner as in the ordinary typewriters or the printers. On the other hand, if the guide plate 325 is positioned to extend almost horizontally, as shown by the interrupted line in FIG. 23, an individual cut piece of paper S of thick type such as a postcard can be inserted from the guide plane 326 into the paper guide path 321 in such a manner that the printing paper is bent slightly.

As shown in FIGS. 23 and 24, a resilient film 341 is attached at the end of the guide plate 325 and projects toward the paper guide path 321. The front edge of the resilient film 341 is touching or extremely adjacent to the paper path member 320 which provides a base wall of the paper guide path 321. When the angle of the guide plane 326 relative to the paper guide path 321 is changed owing to the rotation of the guide plate 325, the resilient film 341 is bent in an arc while keeping in contact with the paper path member 320.

Therefore, the resilient film 341 facilitates insertion of the printing paper S along the guide plane 326 and the upper surface of the resilient film 341 into the paper guide path 321 in both cases, namely; in one case when the guide plane 326 on the guide plate 325 meets the paper guide path 321 at a larger angle as shown by the interrupted line in FIG. 23, and in the other case when the guide plane 326 meets the paper guide path 321 substantially at a right angle as shown by the solid line in FIG. 23.

Furthermore, in the third embodiment, the tractor unit 305 is located below the guide plate 325 to feed the continuous web C into the paper guide path 321 in such a manner that the web C passes below the resilient film 341. As a result, the continuous web C, in passing below the resilient film 341, is held under certain pressure between the resilient film 341 and the paper path member 320, and the continuous web C is provided with resistance to feeding stream. Therefore, the continuous web C is kept in contact with the printing position on the platen 311, and furthermore the central part of the web C with respect to the width of the web is unlikely to get loose apart from the printing position.

Next, the description will be given for the assembly of a sliding plate 327 on the guide plate 325. As shown in FIGS. 23 and 25, a pair of grooves 334 and 335 are provided in parallel each other perpendicularly to the paper feed direction on the upper surface of the guide plate 325. Both grooves 334 and 335 are grooved aslant so that they are apart from each other the most at their bottoms. On the other hand, a pair of mount projections 336 and 337 project from the front edge and the rear edge, respectively, of the lower surface of the sliding guide 327. Both mount projections 336 and 337 project outward so that they are apart from each other the most at their edges.

Owing to the above-stated structure, the sliding guide 327 can be easily assembled on the guide plate 325 as follows. First, the sliding guide 327 is resiliently bent inward in the longitudinal direction. Then, the mount projections 336 and 337 of the sliding guide 327 are inserted in the grooves 334 and 335 on the guide plate 325, and thereafter the sliding guide 327 is flattened again so as to fit the mount projections 336 and 337 in the grooves 334 and 335. In this assembled state, the mount projections 336 and 337 are not likely to come off the grooves 334 and 335 undesirably since both the grooves and the mount projections extend outward. Furthermore, because of the accurate engagement of the grooves 334 and 335 with the mount projections 336 and 337, the sliding guide 327 can be smoothly slid on the guide plate 325 without being twisted, and disposed at a proper position for determining the width of the printing paper S.

As shown in FIGS. 23, 24 and 25, a side wall 327*a* projects upward from one edge of the sliding guide 327. The side wall 327*a* includes a block bar 342 extending out to the paper guide path 321. A hook 342*a* projects upward at the end of the block bar 342. The guide plane 326 on the manual guide plate 325 is large enough for carrying the folded continuous web C thereon.

Next, the detailed description will be given for the paper discharge portion 328 and the paper tray 329. The upper case 302 of the printer case 301 comprises the window 343. Below the window 343, a lower portion of a transparent mounting plate 344 is fixed on the inner surface of the upper case 302. An upper portion of the mounting plate 344 projects toward the window 343 and it is attached with a resilient film 345 on the outer surface. The upper edge of the resilient film 345 comes into contact with the outer surface of the lower feeding rollers 319. Referring to FIG. 26, the upper feeding rollers 318 consist of a number of rollers spaced along the axis of the rollers. A comb-type resilient film 346 attached on the guide member 330 extends via the lower surface of each feeding roller 318 until it is fixed on the upper edge of the window 343 as shown in FIG. 23. The resilient films 345 and 346 shut the window 343 for soundproofing. Furthermore, the resilient film 345 adjacent to the lower feeding rollers 319 is provided with a scale 347 at the upper edge thereof for indicating the printing location.

Referring to FIGS. 27 and 28, each sideward edge of the mounting portion of the paper tray 29 is provided with a slit portion 348 which is formed with three sides being slit and which has resiliency in the sideward direction. The slit portion 349 includes a depression 349 at the end. The depression 349 is removably engaged with a protrusion 350 which is formed at each lowest and sideward end of the window 343. Thus, the paper tray 329 is supported rotatably upward and downward below the feeding rollers 318 and 319.

Referring to FIGS. 29 and 30, the mounting of the paper tray 329 on the mounting plate 344 will now be described in further detail. Each sideward edge of the outer surface of the mounting plate 344 is provided with a stop hole 351 which includes a stop plane 351*a* at the upper end and a stop protrusion 352 at the bottom. On the other hand, the paper tray 329 is provided with a stop projection 353 at the end portion. The stop projection 353 is engaged with either the stop plane 351*a* or the stop protrusion 352 so that the paper tray 329 can be rotated into two positions. To elaborate, when the stop projection 353 is engaged with the stop plane 351*a* as shown in FIG. 29, the paper tray 329 is disposed in a first position (I) where the paper tray 329 extends substantially in parallel with the paper discharge direction as shown in FIG. 23. On the other hand, when the stop projection 353 goes beyond the stop protrusion 352 due to its resiliency so that it is engaged with the stop protrusion 352 as shown in FIG. 30, the paper tray 329 is disposed in a second position (II) where the paper tray 329 stands upward to make an acute angle with the paper discharge direction which slants upward.

Now, an example of paper feeding in the third embodiment will be given as concerns when an individual cut sheet of paper S is to be printed. Referring to FIG. 23, the manual guide plate 325 is disposed either aslant as shown by the solid line in FIG. 23 or horizontally as shown by the interrupted line in FIG. 23. The sliding guides 327 on the manual paper guide 325 are slid according to the width of the paper. The paper tray 329 is disposed in the first position (I). In this condition, an individual cut sheet of paper S put on the manual paper guide 325 is guided by the guide plane 326 as well as by the sliding guides 327 so as to be fed into the paper guide path 321. After printed, the paper S is discharged from the paper discharge portion 328 and stacked on the paper tray 329.

Next, another example of paper feeding in the third embodiment will be given as concerns when a continuous web C is to be printed. As shown in FIG. 24, the manual guide plate 325 is disposed horizontally. The sliding guides 327 on the manual guide plate 325 are slid inward so as to make the interval between both sliding guides 327 narrower than the width of the paper C. The paper tray 329 is disposed in the second position (II). In this condition, a continuous web C stacked between the leg portions 303*a* is guided by the tractor unit 305 and by the feeding rollers 316 and 317 so as to be fed into the paper guide path 321. After printed, the web C is discharged toward the paper tray 329 from the paper discharge portion 328. Then, the discharge direction of the web C is reversed upward without fail while the web C keeps in contact with the paper tray 329. As a result, the discharged continuous web C goes over the printer case 301 to reach the upper surface of the manual guide plate 325 where the continuous web C is continuously folded. In this second example, when the discharged continuous web C is put on the manual guide plate 325, the front edge of the web C tends to proceed toward the paper guide path 321 due to the weight of the paper extending over the printing case 301. However, the continuous web C is put on the block bar 342, and thereafter the hook 342*a* of the block bar 342 blocks the front edge of the continuous web C in its progress toward the printing position.

If an individual cut sheet of paper S is to be printed after printing the continuous web C as described above, the block bar 342 as well as the sliding guides 327 are moved from the blocking position and the sliding guides 327 are slid according to the width of the paper S.

In the above-stated third embodiment, the printed continuous web C is stacked on the manual guide plate 325. However, it may pass over the manual guide plate 325 and be stacked on a desk or a table where the printer is located.

Obviously many modifications and variations of the present invention are possible in the light of the above teachings. It is therefore to be understood that within the scope of the appended claims in the invention may be practiced otherwise than as specifically described.

What is claimed is:

1. A printer comprising a platen, a print head which faces said platen so as to print out on a sheet of printing paper at a printing position on said platen, a paper guide path for guiding the printing paper through said printing position, and a guide means having a guide plane for inserting a sheet of printing paper in said guide path;

wherein said paper guide path comprises a paper inlet portion at one end thereof for inserting the printing paper thereto and a paper discharge portion at the other end thereof for discharging the printing paper therefrom, said paper guide path is a substantially flat path extending from said paper inlet portion to said paper discharge portion, and said guide plane of said guide means is connected with said paper inlet portion of said paper guide path and meets said paper guide path at an obtuse angle, and wherein said paper guide path slants upward in the paper feed direction so that said paper inlet portion is located lower than said paper discharge portion, and wherein said print head is located below said platen so as to print on a lower surface of the printing paper in said paper guide path.

2. A printer according to claim 1, wherein said paper guide path comprises a pair of feeding rollers at the paper inlet portion and another pair of feeding rollers at the paper discharge portion in such a manner that said platen is located between one pair of feeding rollers at the paper inlet portion and the other pair of feeding rollers at the paper discharge portion.

3. A printer according to claim 2 wherein said printing position on the platen is disposed closer to said print head than to a straight line connecting a pair of the feeding rollers on the paper inlet portion and the other pair of the feeding rollers on the paper discharge portion.

4. A printer according to claim 1, wherein said paper guide path is formed between a guide member and a paper path member, said guide member being disposed on the upper side of a tangent line of the printing position on said platen and said paper path member being disposed on the lower side of the tangent line thereof.

5. A printer comprising a platen, a print head which faces said platen so as to print out on a sheet of printing paper at a printing position on said platen, a paper guide path for guiding the printing paper through said printing position, and a guide means having a guide plane for inserting a sheet of printing paper in said guide path;

wherein said paper guide path comprises a paper inlet portion at one end thereof for inserting the printing paper thereto and a paper discharge portion at the other end thereof for discharging the printing paper therefrom, said paper guide path slanting upward to the paper feed direction so that said paper inlet portion is located lower than said paper discharge portion; and said paper guide path is a substantially flat path extending from said paper inlet portion to said paper discharge portion, said guide plane of said guide means is connected with said paper inlet portion of said paper guide path and meets said paper guide path at an obtuse angle;

wherein said paper guide path is formed between a guide member and a paper path member, said guide member being disposed on the upper side of a tangent line of the printing position on said platen and said paper path member being disposed on the lower side of the tangent line thereof, and wherein the edge of said guide means is attached with a resilient film projecting forward said paper guide path and being extremely adjacent to said paper path member.

6. A printer according to claim 5, wherein said edge of said guide means is supported rotatably around an axis which is parallel to an edge line of said path member at the paper inlet portion, thereby bending and keeping said resilient film in contact with said paper path member, and changing an angle defined by said guide means and said paper guide path selectively from at least two angles.

7. A printer comprising a platen, a print head which faces said platen so as to print out on a sheet of printing paper at a printing position on said platen, a paper guide path for guiding the printing paper through said printing position, a guide means for inserting a sheet of printing paper in said paper guide path, and pin tractor means for feeding a continuous web into said paper guide path, the continuous web comprising pin feed holes along outer edges thereof so as to be engaged, with said pin tractor means;

wherein said paper guide path comprises a paper inlet portion at one end thereof for inserting paper to be printed thereto and a paper discharge portion at the other end thereof for discharging printed paper therefrom, said guide means and said pin tractor means being disposed at said paper inlet portion of said paper guide path, and wherein said printer further comprises a reverse guide means provided at said paper discharge portion and selectively disposed in a first position and in a second position, said first position being provided whereby paper discharged from said paper discharge portion moves unobstructed in the extended direction of the paper feed direction, and said second position being provided whereby paper discharged from said paper discharge portion is directed by said reverse guide means away from the extended direction of paper feed.

8. A printer according to claim 7, wherein said paper guide path slants upward to the paper feed direction so that said paper inlet position is located lower than said paper discharge portion.

9. A printer according to claim 8, wherein an upper surface of said reverse guide means is disposed substantially in parallel to the paper feed direction when said reverse guide means is located in said first position, thereby stacking the discharged printing paper on the upper surface of said reverse guide means, and further wherein, when the reverse guide means is in the second position, the upper surface of said reverse guide means meets the discharged continuous web at a predetermined angle, thereby reversing the paper discharge direction.

10. A printer according to claim 7, wherein the reverse guide means is positioned with respect to the guide means so that, when said reverse guide means is disposed in said second position to reverse the direction of the continuous web, the discharged and reversed continuous web is stacked on said guide means.

11. A printer having a platen, a print head which faces said platen so as to print out on a sheet of printing paper at a printing position on said platen, and a paper guide path for guiding the printing paper through said printing position, said printer comprising:

guide means having a guide plane for inserting a sheet of printing paper in said paper guide path;

pin tractor means installed below said guide means for feeding a continuous web into said paper guide path, the continuous web comprising pin feed holes along other edges thereof so as to be engaged with said pin tractor means;

said guide means and said pin tractor means being located adjacent the inlet portion of the guide path;

wherein said paper guide path is substantially flat and slants upward so that a paper inlet portion thereof is located lower than a paper discharge portion, said guide plane on said guide means is disposed substantially in a horizontal manner, and said pin tractor means slants substantially in the same direction as said paper guide path.

12. A printer according to claim 11, wherein an end portion of said pin tractor means near said paper guide path located adjacent to a lower surface of said guide means, so that the lower surface of said guide means prevents the continuous web from leaving a predetermined course thereof.

13. A printer according to claim 11, wherein said print head is located below said platen so as to print out on a lower surface of the printing paper in said paper guide path.

14. A printer according to claim 11, wherein said paper guide path comprises a pair of feeding rollers at the paper inlet portion and another pair of feeding rollers at the paper discharge portion in such a manner that said platen is located between one pair of feeding rollers at the paper inlet portion and the other pair of feeding rollers at the paper discharge portion.

15. A printer comprising a platen, a print head which faces said platen so as to print out on a sheet of printing paper at a printing paper through said printing position, and guiding the printing paper through said printing position, and guide means having a guide plane for inserting a sheet of printing paper in said guide path;

pin tractor means installed below said guide means for feeding a continuous web into said paper guide path, the continuous web comprising pin feed holes along outer edges thereof so as to be engaged with said pin tractor means;

wherein said paper guide path comprises a paper inlet portion at one end thereof for inserting the printing paper thereto and a paper discharge portion at the other end thereof for discharging the printing paper therefrom;

the guide means and pin tractor means being positioned adjacent the inlet portion said paper guide path is a substantially flat path extending from said paper inlet portion to said paper discharge portion whereby said pin tractor means are on the same plane; and said guide plane of said guide means is connected with said paper inlet portion of said paper guide path and meets said paper guide path at an obtuse angle.

16. A printer according to claim 15, wherein said paper guide path slants upward to the paper feed direction so that said paper inlet portion is located lower than said paper discharge portion.

17. A printer according to claim 16, wherein said print head is located below said platen so as to print out on a lower surface of the printing paper in said paper guide path.

18. A printer according to claim 17, wherein said paper guide path comprises a pair of feeding rollers at the paper inlet portion and another pair of feeding rollers at the paper discharge portion in such a manner that said platen is located between one pair of feeding rollers at the paper inlet portion and the other pair of feeding rollers at the paper discharge portion.

19. A printer according to claim 18, wherein said paper guide path is formed between a guide member and a paper path member, said guide member being disposed on the upper side of a tangent line of the printing position on said platen and said paper path member being disposed on the lower side of the tangent line thereof.

20. A printer according to claim 19, wherein an edge of said guide means is attached with a resilient film projecting toward said paper guide path and being extremely adjacent to said paper path member.

21. A printer according to claim 20, wherein said pin tractor means installed below said guide means feeds a continuous web into said paper guide path through a space between said resilient film and said paper path member, and said continuous web comprises pin feed holes along outer edges thereof so as to be engaged with said pin tractor means.

22. A printer comprising a platen, a print head which faces said platen so as to print out on a sheet of printing paper at a printing paper through said printing position, and guiding the printing paper through said printing position, and pin tractor means for feeding a continuous web into said paper guide path, the continuous web comprising pin feed holes along outer edges thereof so as to be engaged with said pin tractor means;

wherein said paper guide path comprises a paper inlet portion at one end thereof for inserting paper to be printed thereto and a paper discharge portion at the other end thereof for discharging the printing paper therefrom, wherein said printer further comprises a reverse guide means provided at said paper discharge portion and selectively disposed in a first position and in a second position, said first position being provided whereby paper discharged from said paper discharge portion moves unobstructed in the extended direction of the paper feed direction, and said second position being provided whereby paper discharged from said paper discharge portion is directed by said reverse guide means away from the extended direction of paper feed.

* * * * *